US009365392B2

(12) United States Patent
Jacobs

(10) Patent No.: US 9,365,392 B2
(45) Date of Patent: Jun. 14, 2016

(54) SYSTEM HAVING MULTIPLE CABS IN AN ELEVATOR SHAFT AND CONTROL METHOD THEREOF

(71) Applicant: SMART LIFTS, LLC, Menlo Park, CA (US)

(72) Inventor: Justin Jacobs, Menlo Park, CA (US)

(73) Assignee: Smart Lifts, LLC, Menlo Park, CA (US)

( * ) Notice: Subject to any disclaimer, the term of this patent is extended or adjusted under 35 U.S.C. 154(b) by 202 days.

(21) Appl. No.: 14/292,726

(22) Filed: May 30, 2014

(65) Prior Publication Data

US 2014/0262628 A1 Sep. 18, 2014

Related U.S. Application Data

(63) Continuation-in-part of application No. 13/952,528, filed on Jul. 26, 2013, which is a continuation-in-part of application No. 13/850,107, filed on Mar. 25, 2013, which is a continuation of application No. 13/009,701, filed on Jan. 19, 2011, now Pat. No. 8,430,210.

(60) Provisional application No. 61/829,996, filed on May 31, 2013.

(51) Int. Cl.
*B66B 9/00* (2006.01)
*B66B 1/24* (2006.01)
*B66B 11/00* (2006.01)

(52) U.S. Cl.
CPC ..... *B66B 1/2466* (2013.01); *B66B 11/0095* (2013.01); *B66B 2201/223* (2013.01)

(58) Field of Classification Search
CPC ..... B66B 1/2466; B66B 11/0095; B66B 2201/223
USPC ..... 187/247, 249, 380–388, 391–393
See application file for complete search history.

(56) References Cited

U.S. PATENT DOCUMENTS 4,356,890 A 11/1982 Smart
5,865,274 A * 2/1999 Kiji ..... B66B 1/2458 187/249

(Continued)

FOREIGN PATENT DOCUMENTS

WO WO2010061036 A1 6/2010

OTHER PUBLICATIONS

International Search Report, mailing date of Apr. 13, 2015, for corresponding International Application No. PCT/US2014/40568.

(Continued)

*Primary Examiner* — Anthony Salata
(74) *Attorney, Agent, or Firm* — Intellectual Property Law Group LLP

(57) ABSTRACT

An elevator system which utilizes a plurality of independently moving cabs in each elevator shaft. The lower cabs are connected to spatially separated counterweights in order to prevent interference between cables, pulleys and counterweights. The top cab may be connected to one or two counterweights by connection points on the roof of the cab. The cabs are mounted on tracks, to guide each cab through the elevator shaft. The system includes a motor attached to each of the cabs by lift cables to facilitate the independent movement of all cabs. Existing buildings can be retrofit for compatibility with the present invention. A system and method for controlling the motions of all cabs comprising determining and selecting an optimal cab and a best hoistway range to service passenger requests.

23 Claims, 18 Drawing Sheets

(56) References Cited

U.S. PATENT DOCUMENTS 6,871,727 B2 * 3/2005 Jokela ..... B66B 1/18 187/249
7,032,716 B2 * 4/2006 Meyle ..... B66B 1/2458 187/249
7,353,913 B2 4/2008 Hashiguchi
7,389,857 B2 * 6/2008 Hikita ..... B66B 1/2466 187/249
7,461,721 B2 12/2008 Aulanko et al.
7,487,860 B2 * 2/2009 Hikita ..... B66B 1/2433 187/249
7,784,588 B2 * 8/2010 SikShin ..... B66B 1/2433 187/249
7,987,947 B2 * 8/2011 Christy ..... B66B 1/468 187/249
8,047,333 B2 11/2011 Finschi
8,052,124 B2 11/2011 Monzon et al.
8,052,820 B2 11/2011 O'Donnell et al.
8,083,033 B2 12/2011 Kallioniemi et al.
8,087,497 B2 1/2012 Fargo
8,091,687 B2 1/2012 Hamaji
8,103,105 B2 1/2012 Kuroda et al.
8,109,367 B2 2/2012 Ach
8,113,319 B2 2/2012 Anttila et al.
8,118,138 B2 2/2012 Aulanko et al.
8,118,139 B2 2/2012 Chen
8,123,002 B2 2/2012 Smith et al.
8,123,020 B2 2/2012 Fang et al.
8,127,893 B2 3/2012 Mustalahti et al.
8,132,652 B2 * 3/2012 Hakala ..... B66B 1/2458 187/249
8,136,637 B2 3/2012 Coquerelle et al.
8,141,684 B2 3/2012 Bjorni et al.
8,141,685 B2 3/2012 Utsunomiya
8,146,714 B2 4/2012 Blasko
8,151,950 B2 4/2012 Fargo
8,157,058 B2 4/2012 Ach
8,162,109 B2 4/2012 Amano
8,172,041 B2 5/2012 Kawasaki et al.
8,177,032 B2 5/2012 Hashimoto
8,177,036 B2 5/2012 Stanley et al.
D662,002 S 6/2012 Lee et al.
8,205,720 B2 6/2012 Barneman
8,205,721 B2 6/2012 Korhonen et al.
8,205,722 B2 6/2012 Suihkonen et al.
8,210,320 B2 7/2012 Ach
8,235,178 B2 8/2012 Kocher
8,235,179 B2 8/2012 Valjus et al.
8,235,180 B2 8/2012 Kattainen et al.
8,235,199 B2 8/2012 Illedits et al.
8,240,453 B2 8/2012 Miyaji
8,251,186 B2 8/2012 Webster et al.
D667,745 S 9/2012 Wu
8,256,579 B2 9/2012 Jia
8,256,582 B2 9/2012 Qiu
8,261,885 B2 9/2012 Ketoviita et al.
8,261,886 B2 9/2012 Kigawa et al.
8,267,224 B2 9/2012 Gremaud et al.
8,272,481 B2 9/2012 Tracey et al.
8,272,482 B2 9/2012 Takahashi et al.
8,276,715 B2 10/2012 Smith et al.
8,286,778 B2 10/2012 Grobbel
8,297,409 B2 * 10/2012 Hsu ..... B66B 1/2433 187/247
8,297,413 B2 10/2012 Kigawa et al.
D670,747 S 11/2012 Stroud et al.
8,307,952 B2 11/2012 Fargo et al.
8,307,953 B2 11/2012 Ferreira
8,424,650 B2 * 4/2013 Brand ..... B66B 1/2433 187/249
8,905,195 B2 * 12/2014 Finschi ..... B66B 1/2458 187/249
2003/0217893 A1 11/2003 Dunser et al.
2010/0078266 A1 4/2010 Choi
2010/0282543 A1 11/2010 Hsu et al.
2012/0012427 A1 1/2012 Kostka et al.

OTHER PUBLICATIONS

International Application Written Opinion of the International Searching Authority, mailing date of Apr. 13, 2015, for corresponding International Application No. PCT/US2014/40568.

* cited by examiner

| FLOORS | S1 | S2 | |
|---|---|---|---|
| A3 | C1 | | |
| A2 | ↓ | | |
| A1 | | | |
| 35 | | ↑ | Company J |
| 34 | C2 | | Company I |
| 33 | ↓ | | |
| 32 | | C1 | |
| 31 | | | Company H |
| 30 | | | |
| 29 | | | |
| 28 | | ↓ | Company G |
| 27 | | ↑ | |
| 26 | | | |
| 25 | C3 | | |
| 24 | ↓ | C2 | |
| 23 | | | Company F |
| 22 | | | |
| 21 | | | Company E |
| 20 | | ↓ | |
| 19 | | ↑ | |
| 18 | | | |
| 17 | | | Company D |
| 16 | | | |
| 15 | | C3 | |
| 14 | C4 | | Company C |
| 13 | ↓ | | |
| 12 | | | |
| 11 | ↑ | ↓ | |
| 10 | C1 | ↑ | Company B |
| 9 | | | |
| 8 | | | |
| 7 | | | |
| 6 | | C4 | |
| 5 | | | |
| 4 | | | Company A |
| 3 | | | |
| 2 | ↑ | ↓ | |
| 1 | C2 | C1 | Numerous Retail Companies |
| B1 | ↑ | C2 | |
| B2 | C3 | C3 | |
| B3 | C4 | C4 | |

FIG. 6

| Floors | S1 | S2 | | S3 |
|---|---|---|---|---|
| A3 | C1 | | | |
| A2 | ↓ | | | |
| A1 | | | | |
| 35 | | ↑ | Company J | |
| 34 | C2 | | Company I | ↑ |
| 33 | ↓ | | | I |
| 32 | | C1 | | ↓ |
| 31 | | | Company H | ↑ |
| 30 | | | | H |
| 29 | | | | ↓ |
| 28 | | ↓ | Company G | ↑ |
| 27 | | ↑ | | |
| 26 | | | | G |
| 25 | C3 | | | |
| 24 | ↓ | C2 | | ↓ |
| 23 | | | Company F | ↑ |
| 22 | | | | F ↓ |
| 21 | | | Company E | ↑ |
| 20 | | ↓ | | |
| 19 | | ↑ | | E |
| 18 | | | | ↓ |
| 17 | | | Company D | ↑ |
| 16 | | | | D |
| 15 | | C3 | | ↓ |
| 14 | C4 | | Company C | ↑ |
| 13 | ↓ | | | C |
| 12 | | | | |
| 11 | ↑ | ↓ | | ↓ |
| 10 | C1 | ↑ | Company B | ↑ |
| 9 | | | | |
| 8 | | | | B |
| 7 | | | | |
| 6 | | C4 | | |
| 5 | | | | ↓ |
| 4 | | | Company A | ↑ |
| 3 | | | | A |
| 2 | ↑ | ↓ | | ↓ |
| 1 | C2 | C1 | Numerous Retail Companies | |
| B1 | ↑ | C2 | | |
| B2 | C3 | C3 | | |
| B3 | C4 | C4 | | |

FIG. 7

SYSTEM HAVING MULTIPLE CABS IN AN ELEVATOR SHAFT AND CONTROL METHOD THEREOF

CROSS-REFERENCE TO RELATED APPLICATIONS

This application is a continuation-in-part of non-provisional patent application Ser. No. 13/952,528, filed on Jul. 26, 2013, which is a continuation-in-part of non-provisional patent application Ser. No. 13/850,107, filed on Mar. 25, 2013, which is a continuation of non-provisional application Ser. No. 13/009,701 filed on Jan. 19, 2011, now U.S. Pat. No. 8,430,210. This patent application also claims the benefit of priority of provisional patent application Ser. No. 61/829,996, filed May 31, 2013. Each of the non-provisional applications and provisional application are incorporated herein by reference.

FIELD OF INVENTION

The invention generally relates to an elevator system that has one or more elevator cabs which move independently in different vertical sections of the same hoistway and a control method thereof.

BACKGROUND

Current tall buildings have many elevator shafts, but each shaft only has one cab operating in that shaft with one or more counterweight cables attached to the top center of the cab. Therefore, only one cab services each floor throughout the entire hoistway, and the general public normally has access to every cab and every floor in the entire building. This situation leads to inefficiencies and dissatisfactions for building owners, developers, and operators who would like to construct many fewer hoistways and operate many more cabs in each hoistway. As land increases in value in desirable urban locations, the financial pressure to construct taller and taller buildings will also increase. Already over 15 buildings worldwide have been constructed with more than 100 floors each, and two or more of these buildings exceed 150 floors. If the number of elevator hoistways and associated lobbies in these and other very tall buildings can be minimized, and the number of elevator cabs that operate in such elevator shafts can be maximized, then the value, efficiencies and desirabilities of these very expensive tall buildings can also be maximized.

The current situation also leads to inefficiencies and dissatisfactions for companies or individuals that lease or own many adjoining floors in a tall building. Many of them would like their employees or occupants to be able to access all of their adjoining floors without having to take a public elevator between such floors. Most modern companies who lease or own multiple adjoining floors in a tall building would like to have one or more private elevators for the exclusive use of all of its employees and guests, for reasons of privacy, security, efficiency, and commonality. The same is true for tall residential buildings, where one individual or family leases or owns several adjoining floors. Many employees currently waste a lot of time, effort and their company's money by having to leave the company's premises, go out into a public lobby, wait for a crowded public elevator cab moving the entire length of a long hoistway, and then re-enter the company's premises on another floor, not to mention the return trip to the employees desk on the original floor. Company's secrets can also be compromised or lost during this process. Such private elevators for each of such companies or individuals have been either impossible to construct, impractical, inflexible, or extremely costly. As such, there is a need for multi-cab elevator systems that increase hoistway efficiency and maximize the usage of hoistway space within tall buildings. Such multi-cab elevator systems will of course require sophisticated computer control systems and programs that will determine, control and coordinate the motions, speeds, breaking, reservations, destinations, safety, and all other functions and operations of such elevator systems.

SUMMARY

The present invention involves a multi-cab elevator system and control method thereof which allows building owners, operators or developers to construct many fewer hoistways and operate many more elevator cabs in each hoistway. It also permits any individual or company which leases or owns two or more adjoining floors in a tall building, to operate one or more private elevators between all of such individual's or company's adjoining floors in the same hoistway or hoistways. A plurality of elevator cabs can operate in one or more different vertical sections of the same hoistway in a tall building, if each counterweight cable is connected to its associated elevator cab at a point horizontally separated from all other cables. The top cab in a hoistway may (or may not) be designed in the same manner as currently designed elevators with one counterweight cable connected to the center of the cab's roof, because there are no other elevator cabs moving above the top cab which would conflict with its center connected counterweight cable. However, the counterweight cables of all cabs below the top cab must be located outside of the common hoistway path so as not to interfere with the motions of any other cabs or their cables moving vertically through the hoistway.

In one embodiment, each elevator cab is attached to four counterweights by cables which are horizontally and symmetrically separated from each other. Each elevator cab has a separate lift motor and a separate lift cable attached to it, and each lift cable must be horizontally and/or vertically separated from all other cables and other equipment. All lift cables, data and electric power cables connected to each cab and their associated pulleys, must also be horizontally separated from other cables and other equipment. All associated pulleys, counterweights and counterweight channels of the elevator system must likewise be horizontally and/or vertically separated from each other and all other equipment. A computer control system determines, controls and coordinates all of the motions, reservations, destinations, and other functions of all of the cabs in the system.

The computer control system generally comprises one or more processors coupled to a memory, and which is further coupled to a plurality of interface devices. The computer system executes one or more computer software programs to the implement the embodiments of the present invention. The computer programs typically comprise one or more instructions that are stored in a memory on a computer, and that, when read and executed by one or more processors in a computer, cause that computer to perform the operations necessary to execute steps or elements embodying the various aspects of the invention. The software and necessary hardware to perform the functions expected of the system are included in one or more controllers (or control units) of the system.

According to an embodiment of the present invention, there is a control system for a multi-cab elevator system in a structure comprising a plurality of hoistways, each hoistway comprising a plurality of cabs, and at least one destination request device, the control system comprising: a controller for servicing requests in the structure through the destination request device, the controller configured to: receive a passenger request from a requesting floor to a destination floor, said request including information regarding a direction of travel in the structure; determine an optimal hoistway amongst the plurality of hoistways, wherein each hoistway is set to operate in an operational direction, and select the optimal hoistway in response to a determination that the hoistway is moving in the direction of travel of the request and has capacity; determine a best cab amongst the cabs of the optimal hoistway and select the best cab in response to a determination that the cab is within a stopping distance of the requesting floor and has capacity; and delegate the request to the best cab and adding the request to a service list of the best cab.

According to an embodiment of the present invention, there is a method for controlling a multi-cab elevator system on a computer, the elevator system having one or more hoistways, each hoistway having a plurality of cabs, the computer comprising a processor, a memory operatively coupled to the processor, the memory storing code executed by the processor for implementing the method including: receiving a request, said request including information regarding a requested floor and a required direction of movement; determining and selecting an optimal hoistway among the one or more hoistways, wherein a hoistway that is already servicing a prior request to the requested floor, in the required direction of movement, is selected as the optimal hoistway; for a hoistway that is not already servicing a prior request to the requested floor in the required direction of movement, the optimal hoistway is determined and selected from the one or more hoistways utilizing information regarding whether the hoistway is traveling in the direction of movement, has capacity and contains a cab that is traveling within a stopping distance to the requested floor; determining and selecting a best cab among the plurality of cabs in the optimal hoistway, wherein a cab already servicing the requested floor is selected as the best cab; for a cab that is not already servicing the requested floor, the best cab is determined and selected from the plurality of cabs utilizing information regarding whether the cab is within a safe stopping distance of the requested floor; delegating the request to the best cab selected; and moving the best cab to service the request.

In another embodiment of the present invention, there is described a method for controlling a multi-cab elevator system on a computer comprising a processor, a memory operatively coupled to the processor, the memory storing code executed by the processor for implementing the method including: receiving a passenger request from a requesting floor to a destination floor, said request including information regarding a direction of travel in a structure with one or more hoistways, each hoistway comprising a plurality of hoistway ranges and a plurality of cabs, wherein each cab services requests on its corresponding service list; determining an optimal hoistway amongst the one or more hoistways by determining an optimal hoistway range, wherein each hoistway range comprises a plurality of succeeding floors within the structure and is set to operate in an operational direction, and selecting the optimal hoistway range in response to the determination that a hoistway range is moving in the direction of travel of the request and has capacity; determining a best cab amongst the cabs of the optimal hoistway range and selecting the best cab in response to a determination that the cab is within a stopping distance of the requesting floor and has capacity; and delegating the request to the best cab and adding the request to the service list of the best cab.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE DRAWINGS

FIG. 6 is an illustration of the control method of an elevator shaft having multiple cabs in accordance with an embodiment of the present invention.

FIG. 7 is an illustration of the control method of a plurality of elevator hoistways having multiple cabs in accordance with an embodiment of the present invention.

DETAILED DESCRIPTION OF THE INVENTION

Figure 1:
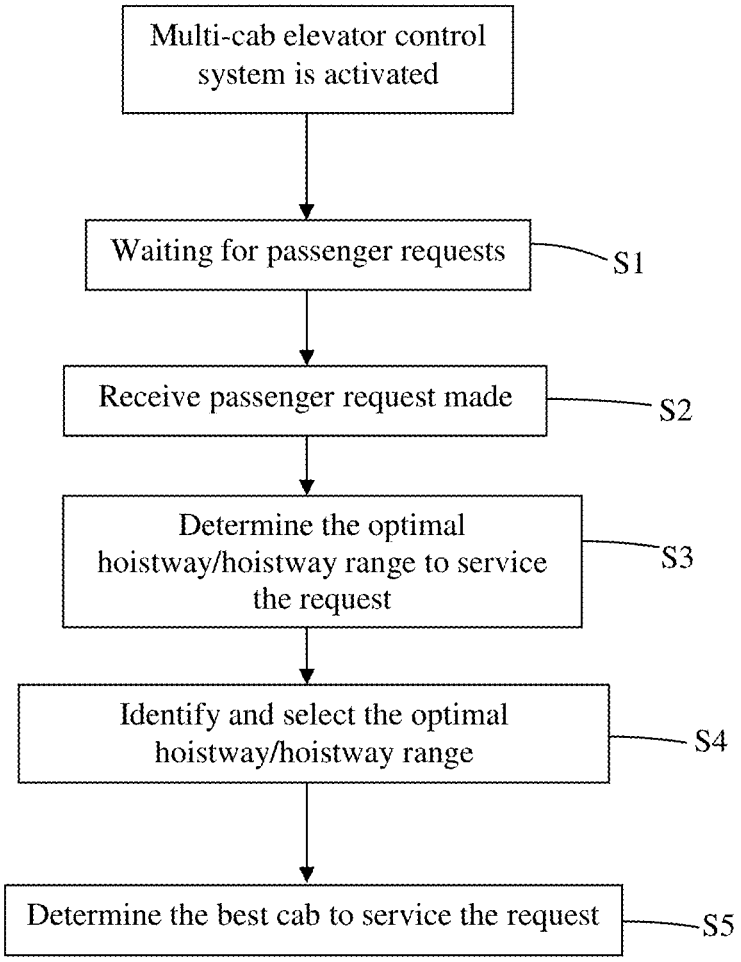
FIG. 1 is a flowchart illustrating an operation of the multi-cab elevator control method, according to an embodiment of the present invention.

An embodiment of the present invention is now described with reference to the figures where like reference numbers indicate identical or functionally similar elements. Also in the figures, the left most digit of each reference number corresponds to the figure in which the reference number is first used.

Reference in the specification to "one embodiment" or to "an embodiment" means that a particular feature, structure, or characteristic described in connection with the embodiments is included in at least one embodiment of the invention. The appearances of the phrase "in one embodiment" in various places in the specification are not necessarily all referring to the same embodiment.

In addition, the language used in the specification has been principally selected for readability and instructional purposes, and may not have been selected to delineate or circumscribe the inventive subject matter. Accordingly, the disclosure of the present invention is intended to be illustrative, but not limiting, of the scope of the invention, which is set forth in the claims.

The multi-cab elevator control system provides a method for one or more passengers to make floor-to-floor requests. The elevator control system manages and controls a plurality of elevator cabs in one or more hoistways (or shafts) within a building or structure. In an exemplary embodiment of the invention, the control system controls a number of hoistways. These hoistways are generally located in a common or centralized area. It is envisioned that a separate but similarly functioning control system may control a hoistway or group of hoistways in a different area of the building. When a passenger request is made from within the centralized area, the control system delegates that request to a hoistway located within that area. The hoistways discussed hereinafter refer to hoistways located within one centralized area that controlled by the master control system.

The multi-cab elevator control system is a hardware architecture that can be used to implement the control methods as illustrated in the figures according to embodiments of the present invention. The elevator control system includes at least a processing unit interfaced with non-volatile memory, volatile memory, control inputs, control outputs, and communication interfaces. The processing unit executes computer readable medium to perform the functions as described herein.

The non-volatile memory is a computer-readable storage medium that includes executable programs. The volatile memory holds programs and/or data that do not persist upon power cycling. The control inputs acquire analog and/or digital inputs, whereas the control outputs drive analog and/or digital outputs. The communication interface enables intra-system and/or inter-system communication. For example, the communication interface enables communication between the master control system and the cab control equipment (the control) 460. In an alternative embodiment, the master control system manages and controls two or more control systems, each control system controlling a separate group of hoistways.

In an exemplary embodiment of the control system, each hoistway 100 and cab 110 has its own control equipment or micro-control, and the master control system communicates with, manages and controls each micro-control.

First Embodiment

Figure 12:
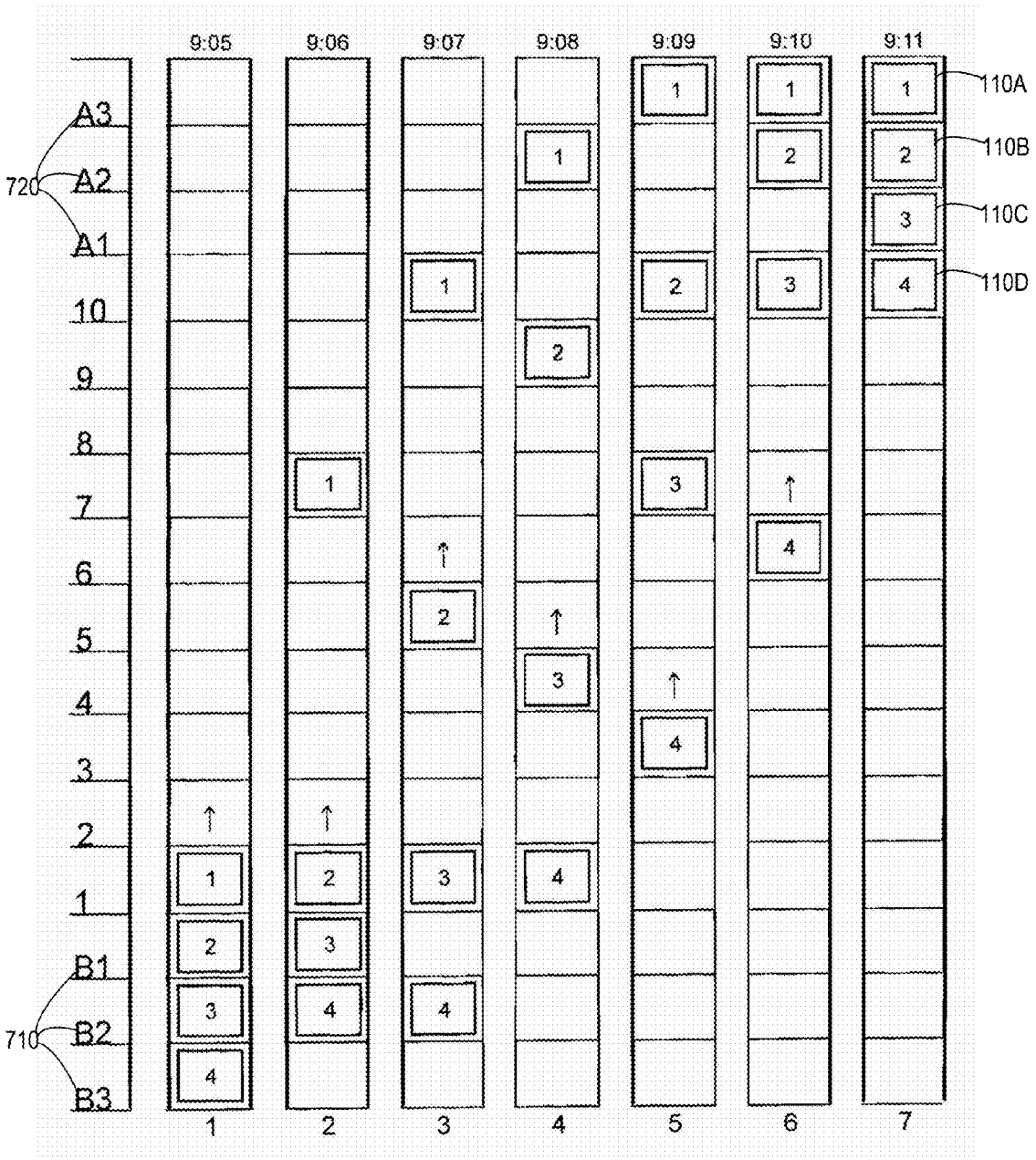
FIG. 12 is an illustration of the operation of an elevator hoistway having multiple cabs moving independently over a period of time in accordance with an embodiment of the present invention.

In a first embodiment of the multi-cab control method, within a hoistway 100, cabs 110 can be docked in attic 720 or basement 710 slots, or in other configurations, as shown in FIG. 12. Depending on where the cabs 110 are docked, the control system sets each hoistway 100 to operate in either the upward or downward direction. When set on an upward operational direction, a hoistway 100 responds to or services upward requests. When set on a downward operational direction, a hoistway 100 responds to downward requests.

In an embodiment of the control method, a hoistway with cabs 110 docked in the attic 720 (as illustrated in configuration 7 of FIG. 12) and set to operate in the downward direction will only respond to and service downward requests. Whereas, a different hoistway with cabs 110 docked in the basement 710 (as illustrated in configuration 1 of FIG. 12) and set to operate in the upward direction will only respond to upward requests. The hoistway 100 set to operate downward (servicing only to downward requests) can later service upward requests after all of its cabs have moved and docked in the basement 710 and its operational direction is switched.

FIG. 1 is a flowchart illustrating a multi-cab elevator control method according to an exemplary embodiment of the present invention.

When the control system is activated and in normal operation, it waits for floor-to-floor requests from passengers (Step S1). Requests are made from active floors. When a request 5 is made, the request contains information regarding the requested floor and the direction of travel (upward or downward). A passenger request 5 can be made by pushing a call button. The control system then processes and delegates the request to the hoistway and the cab best suited to service the request (the optimal hoistway and the best cab). In other embodiments, a passenger request can be made using a keypad, call panel, or other means.

When a request 5 is received (Step S2), the control systems makes a series of determinations to identify the optimal hoistway (and if applicable, optimal hoistway range) and the best cab to service the request 5, as illustrated in FIG. 1.

The optimal hoistway range to service a request is identified by a set of checks (Step S3). The first check can be whether a hoistway is already servicing the request 5. In one embodiment of the control method, if a hoistway is already traveling in the requested direction and has a cab slated to visit the requested floor (from a previous request), then the control system allows the hoistway to process the previous request and the current request together. If this occurs, no additional action is taken by the hoistway or cab. After the requests are processed together, the control system returns to waiting for new requests.

Figure 2:
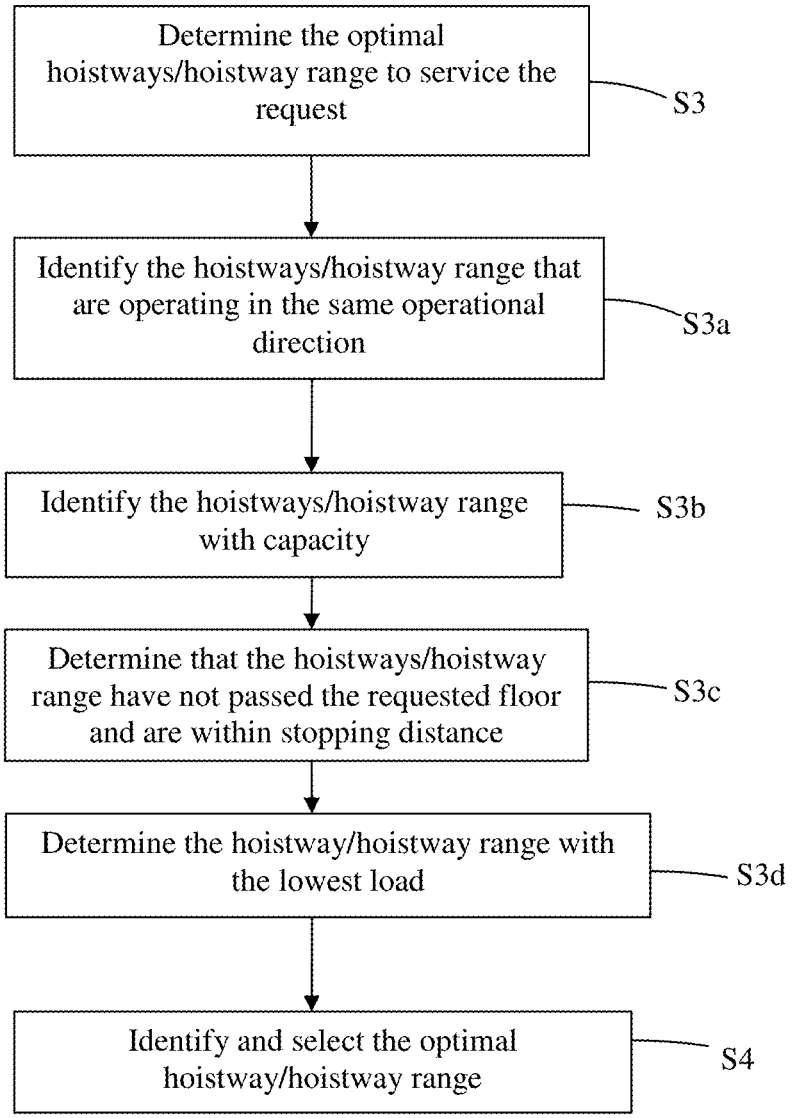
FIG. 2 is a flowchart illustrating an operation of identifying the optimal hoistway of the multi-cab elevator control method, according to an embodiment of the present invention.

When no hoistway could be identified after the first check, the control system checks for hoistways that are traveling in the same direction (Step S3*a*) as the request 5 and has capacity (Step S3*b*), as illustrated in FIG. 2. A hoistway has capacity if any of its cabs have available space to pick up one or more additional passengers. The control system may restrict the number of passengers in a cab or limit the cab's weight capacity. For example, the control system may limit the weight capacity for a cab to 400 pounds. A cab may contain a weight sensor or other means to determine its weight load or capacity. When a cab is at or over its weight limit, it does not have capacity. As such, if all the cabs in a hoistway are at or over their capacity, the hoistway does not have capacity.

When the control system identifies hoistways with capacity (Step S3*b*), as illustrated in FIG. 2, the system then determines whether its cabs with capacity have passed the requested floor and are within stopping distance (Step S3*c*). For example, if there is a request from the top floor going downward, the control system determines whether any of the cabs in a particular hoistway have passed that floor. If all the cabs have passed the floor, then the system delegates the request 5 to another hoistway that has capacity and is moving in the downward direction. In this situation, the request will be serviced by a cab in the other hoistway, or a cab in a hoistway that will switch directions.

When the control system identifies a hoistway with capacity that is set in the direction of the request, and its cabs have not passed the requested floor, it is identified as the optimal hoistway (Step S4).

To increase the efficiency in servicing passenger requests, the control system may operate to balance the load (or load-balance) passenger requests to across numerous hoistways. When more than one hoistway is identified as having capacity and set to move in the same direction, the control system further narrows the selection of hoistways to the one hoistway with the lowest load (Step S3*d*). This operation enables efficiency and balances traffic across hoistways evenly. To balance traffic, or the number of requests serviced by each hoistway, the system can identify the hoistway that is servicing the fewest requests as the optimal hoistway.

In an embodiment of the control method, for example, the control system controls six hoistways and has identified three hoistways with capacity and set to operate in the same direction. Of those three hoistways, the cabs of one hoistway are almost at capacity, the cabs of the second hoistway are at a lesser capacity, and the cabs of the third hoistway are idle. The control system identifies the hoistway with the lowest capacity. In this case, the second hoistway has the lowest capacity. This hoistway can be identified as the optimal hoistway (Step S4). In an alternate embodiment, the idle hoistway may be identified as the optimal hoistway.

As illustrated in FIG. 1, if no optimal hoistway is found, there is a check for an idle or waiting hoistway. In one embodiment, a waiting hoistway may be identified as the optimal hoistway. An idle hoistway is a hoistway with idle cabs. An idle cab has completed servicing all of its delegated requests and has no new pending requests. A waiting hoistway is a hoistway with all of its cabs idle and docked; it is waiting to switch its operational direction. When an idle or waiting hoistway is identified, the control system activates the hoistway and delegates the request 5 to that hoistway. A cab is then dispatched to service it.

In an embodiment of the control method, the first idle hoistway identified by the control system is enabled to service the request. In this embodiment, the control system checks each hoistway sequentially, and the first idle hoistway identified in the sequence is the first idle hoistway.

In an alternate embodiment, a hoistway may be idle when all its cabs are docked (as illustrated in configuration 1 and 7 of FIG. 12). In this embodiment, if the cabs are idle and docked in the attic 720, the control system can send one of its cabs downward to service a down request. If, however, the idle hoistway has cabs that are docked in the basement 710, the control system may send all of its cabs up to the attic 720 to dock. The control system can then change the operational direction of the hoistway and send the last cab 110D downward to service the down request.

When the control system cannot identify an idle hoistway, in this situation, all active hoistways may be moving in the opposite direction. In one embodiment, the control system may then wait for a hoistway to switch operational directions and delegate the request to that hoistway.

In one embodiment, when the control system cannot identify an optimal hoistway, the request may be logged in a list. The control system may then wait until a hoistway becomes available. In this situation, a hoistway may become available when it changes its operational direction. The request 5 is then delegated to that hoistway.

Figure 3:
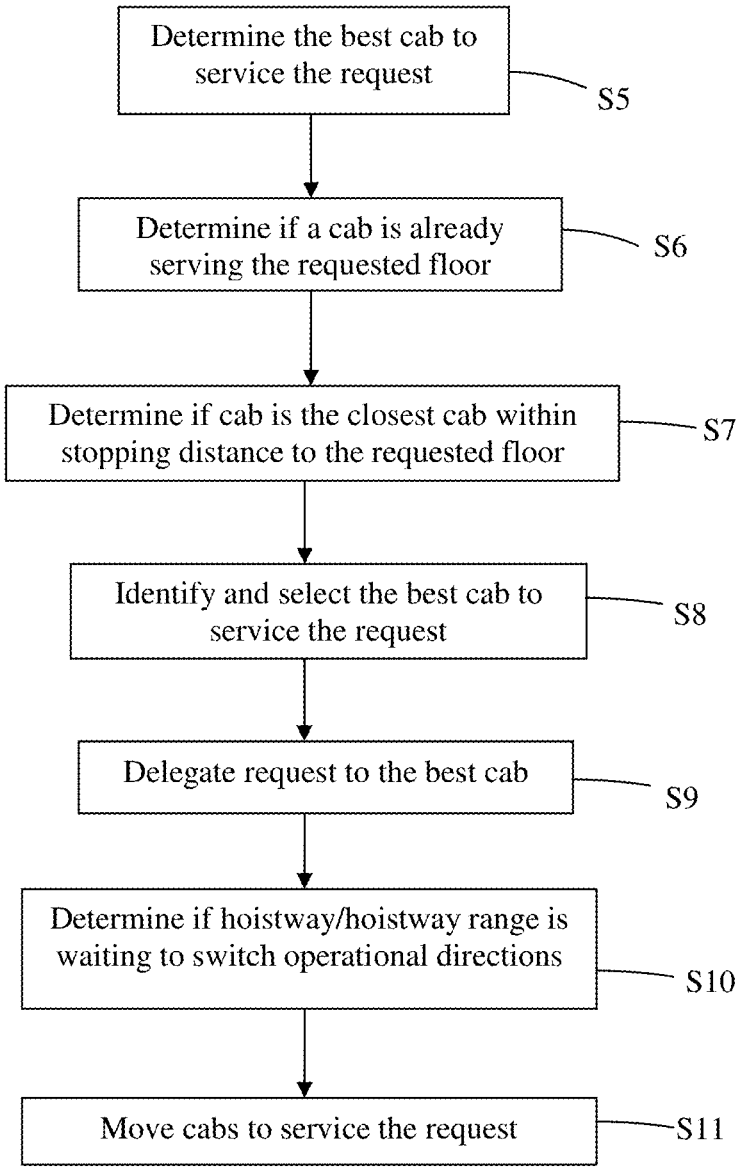
FIG. 3 is a flowchart illustrating an operation of identifying the best cab of the multi-cab elevator control method, according to an embodiment of the present invention.

When an optimal hoistway is identified, the control system then finds the best cab within that hoistway to service the request (Step S5). If a cab is already stopping at the requested floor, the request 5 is automatically delegated to that cab (Step S6), as illustrated in FIG. 3. If the requested floor is not already being serviced, the control system may then identify which cabs have not passed the requested floor. In a preferred embodiment, the control system identifies the closest cab with capacity and within the safest stopping distance to this floor (Step S7). The request is then delegated to that cab (Step S11).

After the best cab is identified (Step S8) and the request is delegated to that cab (Step S9), the request is added to that cab's service queue. The request is added to the queue in the order it can be serviced by the cab.

If the best cab cannot be found, the request is collected and logged. For example, if the control system cannot identify the best cab, in this situation, all the cabs in the optimal hoistway may have passed the requesting floor. The request is then logged as a request that remains to be serviced. This request may then be serviced by another hoistway.

Figure 4:
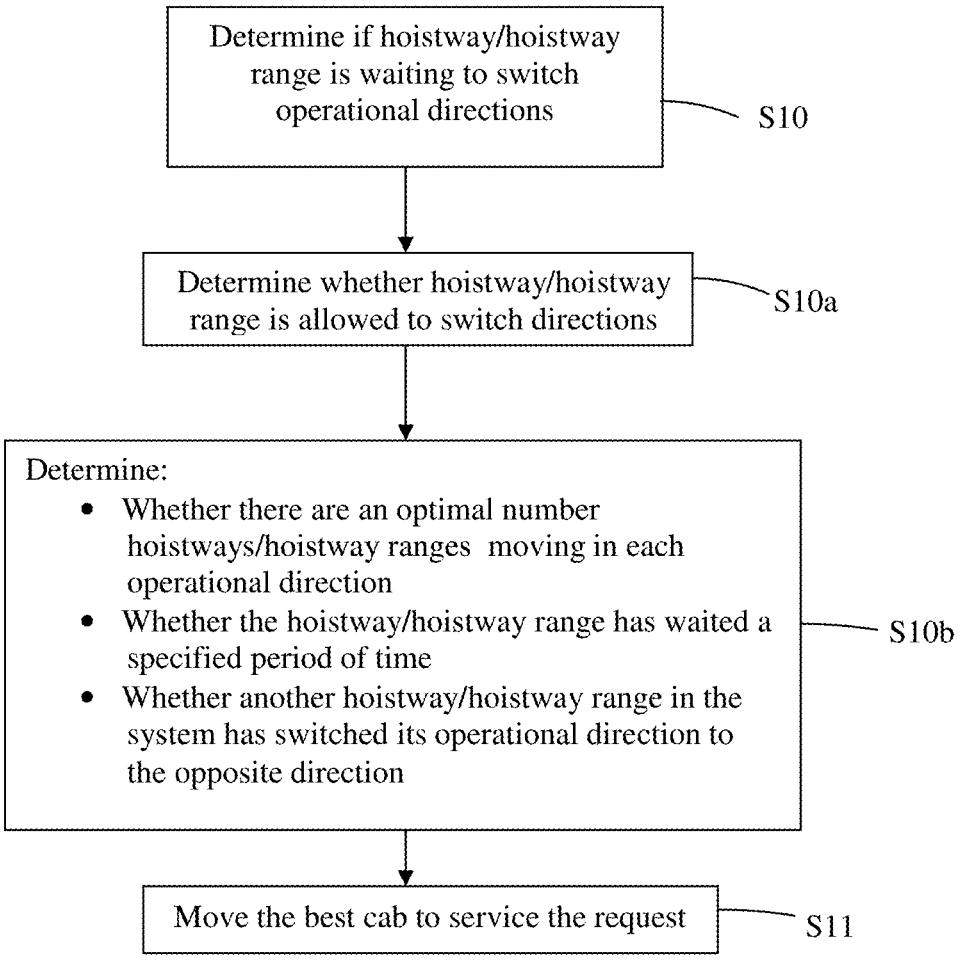
FIG. 4 is a flowchart illustrating an operation of allowing the optimal hoistway to switch directions of the multi-cab elevator control method, according to an embodiment of the present invention.

After the best cab and optimal hoistway are identified, the control system may determine whether the optimal hoistway is waiting to switch its operational direction (Step S10). If the optimal hoistway is waiting to change directions, there is a check to determine whether the hoistway is allowed to switch (Step S10*a*), as illustrated in FIG. 4. In one embodiment, this check can occur prior to cab movement (Step S11), as illustrated in FIG. 3. The check determines whether there are an optimal number of hoistways moving in each direction (Step S10*b*). Alternatively, the check may determine whether the hoistway has waited a specified wait time (Step S10*b*). A hoistway may also be released from a waiting mode when another hoistway in the system switches its operational direction to the opposite direction (Step S10*b*).

For example, if the cabs in the waiting hoistway are docked in the attic 720, the control system checks whether this hoistway can switch its operational direction to the downward direction (Step S10*a*). If there are already an optimal number of hoistways traveling in the downward direction, this hoistway is kept in a waiting mode. When a different hoistway docks in the basement 710 and switches to an upward direction, the waiting hoistway is released from waiting mode, and may now move in the downward direction (Step S10*b*). In a preferred embodiment, an optimal number of hoistways is at least half of all the active hoistways.

Alternatively, the waiting hoistway switches to the downward direction and starts to move its cabs after waiting a set period of time. This ensures that the waiting hoistway is not waiting for an extended period of time. For example, a waiting hoistway may be allowed to switch directions after waiting one minute, a certain amount of cycles, or other measures of time. This allows a hoistway to switch operational directions and move without waiting indefinitely.

In a preferred embodiment, the control system maintains half of the hoistways in a waiting mode and checks to ensure that, at any given time, an optimal number of hoistways are moving in each direction. In this embodiment, the control system prevents the operational directions of all the active hoistways from coming into sync with each other (e.g. all hoistways moving in the same operational direction), unless there is a situation that specifically requires all the hoistways to do so.

A waiting hoistway is allowed to switch directions to balance the directional movements of the hoistways. In an embodiment of the invention, a waiting hoistway switches direction and is allowed to operate in the new direction if less than the optimal numbers of hoistways are traveling in the new direction. For example, when a waiting hoistway has its cabs docked in the attic 720 and it switches to a downward operational direction, a waiting hoistway docked in the basement 710 is activated and allowed to operate in the upward direction.

After passenger make requests for a cab, the control system collects and/or logs the requests as currently active requests. The log may be a list of all new and/or pending requests, including requests logged after the best cab or optimal hoistway could not be found. For example, when a waiting hoistway switches its operational direction upward and is available to service requests, all the upward requests from the log may be split among the cabs of that hoistway. In one embodiment, the collected requests are evenly split or allocated among the cabs of the hoistway, with the top cab 110A receiving any remaining requests. This allows the tailing cabs to pick up subsequent requests as the cabs move in their operational direction.

Figure 5:
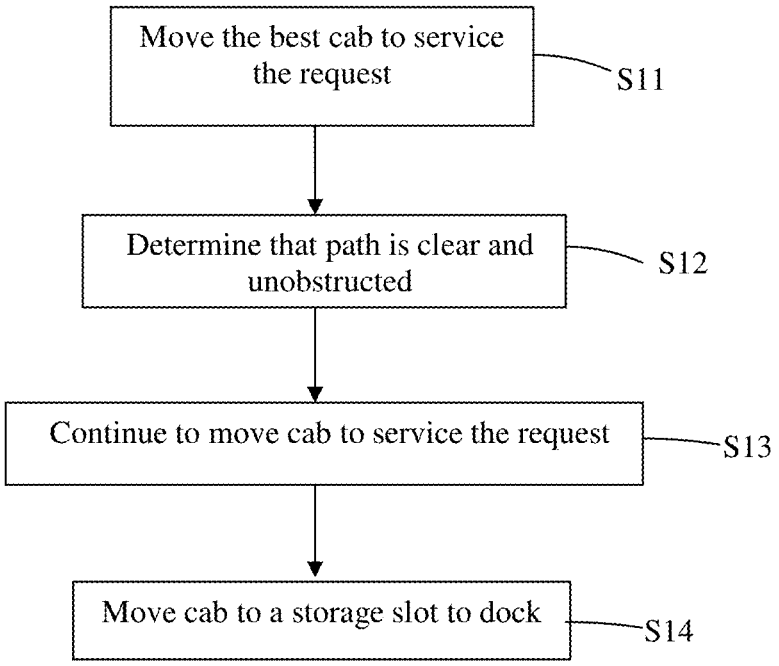
FIG. 5 is a flowchart illustrating a movement operation of the multi-cab elevator control method, according to an embodiment of the present invention.

When a request 5 has been delegated to the best cab (Step S9) and the hoistway is not waiting or switching direction (Step S10), the best cab is moved to service the request (Step S11), as illustrated in FIG. 3. In this movement phase (Step S11), when the cabs move, the control system and/or the cab checks for obstructions to ensure the clear and safe passage of the cabs through the hoistway, as illustrated in FIG. 5.

If a cab is already in motion in the hoistway, there are checks to ensure the path ahead is clear and unobstructed by another cab (Step S12) and checks to ensure there is enough room for the cab to move ahead. If the path is clear, the cab continues to move to its destination to service the request (Step S13). If the path is obstructed by another cab, a communication is sent to request the blocking cab to move forward. If the blocking cab is idle, the communication can be a request for the blocking cab to move one floor past the moving cab's destination. If the blocking cab is stopped at a floor while servicing a passenger request, the blocking cab can communicate with the moving cab that it needs to wait. In this situation, the moving cab must wait for passengers to board or disembark the blocking cab.

In an embodiment of the invention, the control system ensures a minimum distance between cabs to prevent cab collision. In this embodiment, the position of all the cabs within a hoistway is known and the system can order a cab to stop moving if there is a movement conflict. A cab may also independently check if there are obstacles in its path or if the cab is within a safe stopping distance. A cab may also independently check for a minimum distance at each point of movement in addition to at every floor stop.

When a cab is not waiting and stopped at a floor, the cab doors are either open or closed. The cab opens or closes its doors as needed to allow passengers to board or disembark. When a passenger boards the cab and requests a destination floor, the control system checks to ensure that the requested destination floor is consistent with the hoistway's operational direction. In one embodiment, a destination floor request made by a passenger after boarding a cab, similar to a passenger request 5, includes information regarding the requested floor and the direction of travel.

When a cab servicing a requesting floor is filled to capacity and more passenger requests are active on the floor, the control system may delegate the remaining passenger requests to a tailing cab. For example, twenty passengers request a cab and each cab has a twelve person capacity. When the cab stops at the requested floor to service the request, eight passengers are unable to board the cab because they exceed the cab's capacity. If another passenger request is made for that floor, the request is delegated to a tailing cab and the tailing cab can service the eight remaining passengers. This allows for more efficiency and a shortened wait time in servicing multiple passenger requests from the same floor.

When the last cab 110D docks in an attic slot 720 (as illustrated in configuration 7 of FIG. 12), or conversely, the top cab 110A docks in the basement 710 (as illustrated in configuration 1 of FIG. 12), that cab has moved the furthest upward or downward it can. This situation communicates a signal for the hoistway to switch its operational direction. The hoistway can either switch directions and service requests in the opposite direction, or go into a waiting mode before switching (as discussed above).

When all the cabs in a hoistway have completed servicing the requests in their service queue, the cabs have completed their movement. Hence, these cabs may be positioned somewhere within the hoistway, but not docked. The control system may then reset the hoistway to prepare the cabs within the hoistway to service future requests. The control system resets the hoistway by signaling the bottom most cab (cab 4) 110D go all the way to the top of the hoistway to dock (Step S14), as illustrated in FIG. 5. This pushes any idle cabs above it to move upward in the hoistway and dock in the attic (configuration 7 of FIG. 12). Conversely, the top cab (cab 1) 110A may be sent all the way to the bottom of the hoistway, pushing the idle cabs below it to dock in the basement (configuration 1 of FIG. 12). This prepares the hoistway and its cabs to service future requests.

In another embodiment of the invention, a hoistway is idle if all of its cabs are docked, its operational direction is switched, and the control system is awaiting new requests.

In an exemplary embodiment of the invention, as illustrated in FIG. 2, a building has thirty-five leased floors, three basement/parking floors, and three attic/equipment floors. The all the leased floors are active. Hoistway S1 contains four cabs that move independently in the same hoistway. The control method allows the cabs in the hoistway S1 to service all thirty-five leased floors and the three basement/parking floors. The cabs move independently from the four lowest floors (1, B1, B2 and B3) of the building in the upward direction to the highest four floors (35, A1, A2 and A3) where they are stored for a short time. The hoistway S1 may then switch its operational direction, where the cabs move downward and are stored in the four lowest floors. Each cab picks up and delivers passengers along the way in each direction. In this embodiment, the basement and attic slots allow each cab to access and service every leased floor of the building.

In alternate embodiment, cabs can be docked in attic 720 or basement slots 720 horizontally. Using a horizontal docking configuration, all or some of the cabs may be docked or stored on a single attic or basement floor.

Second Embodiment

In a second embodiment of the control method of this invention, the multi-cab elevator system services passenger requests 5 to and from limited floors of the building without the need for attic 720 slots. In this embodiment, a cab may express a passenger to their destination floor without stopping at intermediate floors.

In this embodiment, when a passenger request 5 is made, the method of identifying the optimal hoistway (and if applicable, optimal hoistway range) and best cab to service the request 5 is carried out in the same manner as described in the first embodiment. Since the method is the same, the description will be omitted.

In an embodiment of this control method, one or more of the floors of the building can be disabled or inactive. A passenger request can be made from an active floor to an active destination floor. The passenger's destination floor is limited to active floors and inactive destination floors are not serviced. For example, if Floor 1 and Floor 10 are active, and the Floor 2 through the Floor 9 are inactive, a passenger can make a request from the Floor 1 to travel to Floor 10. The cab, however, will not stop at any of the inactive floors, Floor 2 through Floor 9.

In another exemplary embodiment of the control method, as illustrated in FIG. 6, thirty-five floors of a building are divided into regions. Each region is a range of active floors that is serviced by one of the cabs in a multi-cab hoistway. These active floors are the designated destination floors for a specific cab in the hoistway. Passenger requests are made on Floor 1 going upwards. Four cabs (cab 1, cab 2, cab 3, and cab 4) begin on the lowest four floors of the building (1, B1, B2 and B3) and each stop on Floor 1 to pick up passengers. Cab 1 services the region of Floor 28 through Floor 35 (region 1). Cab 2 services the region of Floor 20 through Floor 27 (region 2). Cab 3 services the region of Floor 11 through Floor 19 (region 3). Cab 4 services the region of Floor 2 through Floor 10 (region 4).

As illustrated in FIG. 6, the top cab (cab 1) is stopped at Floor 1 to allow passengers to board. Upon boarding cab 1, passengers make requests for their destination floor within region 1. After receiving requests for destination floors, Cab 1 travels upward directly to the bottom floor (Floor 28) of the region 1 in the building (Floors 28 through 35). Cab 1 can then move upwards, from Floor 28 through Floor 35, picking up and/or dropping off passengers along the upward direction. After reaching the top most floor of the region (Floor 35), cab 1 switches direction and moves downward from Floor 35 to Floor 28, picking up and/or dropping off passengers along the downward direction. After reaching the lowest floor of the region (Floor 28), cab 1 travels directly downward from Floor 28 to Floor 1. Cab 1 then unloads passengers, awaits new passenger requests for region 1 and repeats the process. Only requests made for floors within region 1 are serviced.

After cab 1 leaves Floor 1, cab 2 moves up to Floor 1 from B1 to pick up passengers with requests to be dropped off in region 2, Floor 20 through Floor 27. Cab 2 then directly travels to Floor 20. Thereafter, it travels upward towards Floor 27 picking up and/or dropping off passengers along the way. After reaching the top most floor of region 2 (Floor 27), cab 2 switches direction and moves downward from Floor 27 to Floor 20, picking up and/or dropping off passengers along the downward direction. After reaching the lowest floor of region 2 (Floor 20), cab 2 travels directly downward from Floor 20 to Floor 1. Cab 2 then unloads passengers, moves down to Floor B1 and awaits new passenger requests for region 2. When a new passenger request is received, cab 2 picks up the new passenger and repeats the process. Only requests made for floors within region 2 are serviced.

After cab 2 leaves Floor 1, cab 3 moves up to Floor 1 from B2 to pick up passengers with requests to be dropped off in region 3, Floor 11 through Floor 19. Cab 3 then directly travels to Floor 11. Thereafter, it travels upward towards Floor 19 picking up and/or dropping off passengers along the way. After reaching the top most floor of region 3 (Floor 19), cab 3 switches direction and moves downward from Floor 19 to Floor 11, picking up and/or dropping off passengers along the downward direction. After reaching the lowest floor of region 3 (Floor 11), cab 3 travels directly downward from Floor 11 to Floor 1. Cab 3 then unloads passengers, moves down to Floor B2 and awaits new passenger requests for region 3. When a new passenger request is received, cab 3 picks up the new passenger and repeats the process. Only requests made for floors within region 3 are serviced.

After cab 3 leaves Floor 1, cab 4 moves up to Floor 1 from B3 to pick up passengers with requests to be dropped off in region 4, Floor 2 through Floor 10. Cab 4 then travels to Floor 2. Thereafter, it travels upward towards Floor 10 picking up and/or dropping off passengers along the way. After reaching the top most floor of region 4 (Floor 10), cab 4 switches direction and moves downward from Floor 10 to Floor 2, picking up and/or dropping off passengers along the downward direction. After reaching the lowest floor of region 2 (Floor 2), cab 3 travels directly downward to Floor 1. Cab 4 then unloads passengers, moves down to Floor B3 and awaits new passenger requests for region 4. When a new passenger request is received, cab 4 picks up the new passenger and repeats the process. Only requests made for floors within region 4 are serviced.

In this embodiment, attic storage slots (A1, A2 and A3) are not necessary because all the leased floors in the building can be serviced by the multi-cab elevator system without cabs docking in the attic storage slots.

In an embodiment of the invention, a multi-cab hoistway 100 utilized to service requests on all the floors of a building can also be enabled to be an express hoistway with cabs that express (or service only regions) from floor to floor. For example, as illustrated in FIG. 6, hoistway S1 can, if desired, be enabled to service regions instead of servicing all floors of the building, and hoistway S2 can be enabled to service all floors instead of servicing regions.

Third Embodiment

In a third embodiment, the elevator system and method controls a multi-cab elevator system to operate as a private elevator system to service specific floor regions of a building.

The private elevator control system provides a method for passengers to make floor-to-floor requests within a specific floor range or region. Each cab within the multi-cab hoistway 100 operates as a private elevator servicing requests within a specific floor range.

The private elevator control system manages and controls a plurality of elevator cabs in one or more hoistways (or shafts) within a building. In an exemplary embodiment of the private elevator system, the control system controls a number of hoistways. These hoistways are generally located in a common or centralized area. It is envisioned that a separate but similarly functioning control system may control a hoistway or group of hoistways in a different area of the building. Alternatively, it is also envisioned that a control system, in addition to controlling hoistways operating to service regions, may also control one or more hoistways (and/or each cab within a hoistway) to operate to service all the floors of the building.

When a passenger request is made, the private control system delegates that request to a hoistway. The control system may control and manage hoistways located generally within a centralized area. The hoistways discussed hereinafter refer to hoistways located within one centralized area, and are controlled by a master control system.

The private elevator control system is a hardware architecture that can be used to implement the control methods as illustrated in the figures according to embodiments of the present invention. The private elevator control system includes at least a processing unit interfaced with non-volatile memory, volatile memory, control inputs, control outputs, and communication interfaces. The processing unit executes computer readable medium to perform the functions as described herein.

The non-volatile memory is a computer-readable storage medium that includes executable programs. The volatile memory holds programs and/or data that do not persist upon power cycling. The control inputs acquire analog and/or digital inputs, whereas the control outputs drive analog and/or digital outputs. The communication interface enables intra-system and/or inter-system communication. For example, the communication interface enables communication between the master control system and the cab control equipment (the control) 460.

In an exemplary embodiment of the private control system, each hoistway 100 and cab 110 has its own control system or micro-control, and the master control system communicates with, manages and controls each micro-control.

In an alternative embodiment, the master control system manages and controls two or more control systems and/or private control systems. Each control system or private control system manages and controls the micro-controls of a hoistway and the cabs within that hoistway.

In an alternative embodiment, the private control system communications with, manages, and controls each hoistway and cab in the elevator system.

In an exemplary embodiment of the invention, the private control method enables each cab of a multi-cab hoistway system to service a specific region, or floor range, of a building. A specific region or floor range of a building may be the designated floor range of a single company occupying those corresponding floors in a building. Each region or floor range may be occupied by a different company or occupant.

In this embodiment, a passenger makes a request from a requesting floor to a destination floor within a specific region. In an embodiment of the invention, a cab is designated to service a specific floor range or region of the building. The control system enables as active for that cab, the floors within that designated region. Floors outside the region are considered inactive.

In an exemplary embodiment of the private elevator control method, each cab in the hoistway operates a private elevator that services a specific floor range and is designated to that region. One cab is allowed to travel within its designated region. Access to the floors outside of a cab's designated region, or into the designated regions of other cabs, is restricted. Attic or basement slots may be outside a cab's designated region and may be unnecessary for the operations of the private elevator control system.

In this embodiment, the movements, as well as the directional movements, of each cab in the hoistway is independent of one another. A cab may move upwards within its designated region while another cab in a different designated region within the same hoistway may move downwards at the same time.

In an exemplary embodiment, a building may be leased by ten or more different companies, where one company may occupy a single floor, part of a floor, or multiple floors (a floor range). A company that occupies a floor range may desire a private elevator that operates only within their floor range or region.

As illustrated in FIG. 7, an elevator hoistway S3 may have nine cabs that move independently of each other, each servicing a region. A region is associated with a single company that leases a floor range within a building; hence, that floor range is that company's designated region. Each of the nine cabs has a designated region and travels up and down within the hoistway to service it.

As illustrated in FIG. 7, each cab only services the designated region of one company. Floors 2 through 4 are occupied by Company A. This floor range is the designated region for Company A and is serviced only by cab A. Similarly, cab B only services Floors 5 through 10 which are occupied by Company B. Cab C only services Floors 11 through 14 which are occupied by Company C. Cab D only services Floors 15 through 17 which are occupied by Company D. Cab E only services Floors 18 through 21 which are occupied by Company E. Cab F only services Floors 22 and 23 which are occupied by Company F. Cab G only services Floors 24 through 28 which are occupied by Company G. Cab H only services Floors 29 through 31 which are occupied by Company H. Cab I only services Floors 32 through 34 which are occupied by Company I.

Companies that occupy only one floor or part of one floor may not need a private elevator. As illustrated in FIG. 7, Company J only occupies Floor 35, a single floor. Hence, Company J does not have a floor range and it is unnecessary for it to have a cab that services a designated region. Similarly, it is unnecessary for companies that occupy a part of Floor 1 to have a private elevator.

In this embodiment, if the occupants of any of the floors of the building wish to go to the floors of another company, the street level on Floor 1, or any of the basement/parking (B1, B2 and B3) floors, they may use a hoistway S1 or S2 that allows access for the general public, as illustrated in FIG. 7. Hoistways that the general public can access are enabled to operate on all floors (hoistway S1) or enabled to service Floor 1 (hoistway S2).

In an embodiment of the private elevator control method, it is unnecessary for the hoistway to have storage slots in the attic or the basement because the cabs service regions and will remain within its designated region or floor ranges. In an alternative embodiment, the storage slots are available to and accessible by the cabs, but are unused.

Figure 8:
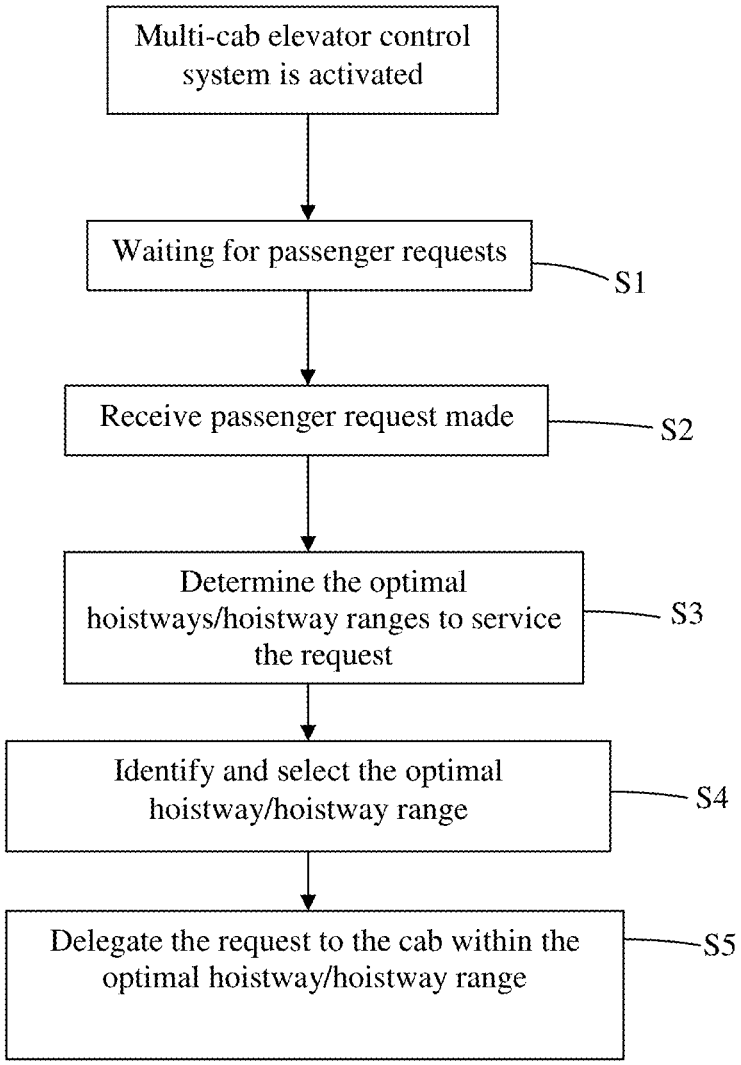
FIG. 8 is a flowchart illustrating an operation of the multi-cab elevator private control method, according to an embodiment of the present invention.

FIG. 8 is a flowchart illustrating a multi-cab elevator private control method according to an embodiment of the present invention. When the private elevator control system is activated and in normal operation, it waits for floor-to-floor requests from passengers (Step S1). Requests are made from active floors and received by the control system (Step S2). When a request is made, it is contains information regarding the destination floor and the direction of travel (upward or downward). A passenger can make a request by pushing a call button. The control system then processes the request, determining, selecting and delegating the request to the hoistway (Step S3 and S4) best suited to service the request (the optimal hoistway and if applicable, optimal hoistway range). The control system then delegates the request to the cab designated to the region of the request (Step S5). In other embodiments, a passenger request can be made using a keypad, call panel, or other means.

When a request is made, the control system determines and selects the optimal hoistway to service the request, as illustrated in FIG. 8.

In an embodiment of the invention, the control system determines whether more than one hoistway is active or enabled to operate as a private elevator hoistway. If only one hoistway is currently active, this hoistway is identified as the optimal hoistway. The request is delegated to this hoistway.

Figure 9:
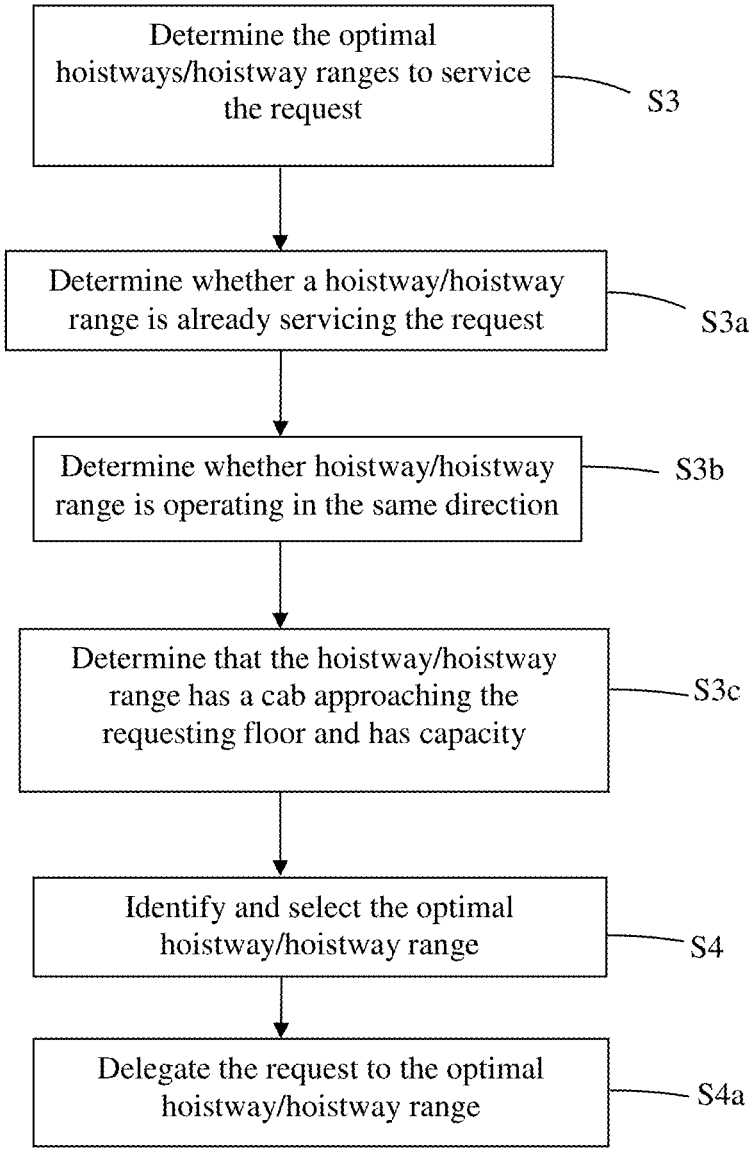
FIG. 9 is a flowchart illustrating an operation of identifying the optimal hoistway in the multi-cab elevator private control method, according to an embodiment of the present invention.

When more than one hoistway is active or enabled to operate as a private elevator hoistway, the control system determines the optimal hoistway to service the request (Step S3). As illustrated in FIG. 9, the control system determines whether a hoistway is already servicing the request (Step S3*a*). In one embodiment, if a hoistway is already traveling in the requested direction and has a cab slated to visit the requested floor (from a previous request), then that hoistway can process the previous request and the current request together. If this occurs, no additional action is taken by the hoistway or cab. After the requests are processed together, the control system returns to waiting for new requests.

If there is no hoistway already servicing the request, the control system determines whether one of the active hoistways is operating in the same direction as the request (Step S3*b*). The control system also determines whether that hoistway has a cab that is approaching the requesting floor (a cab that has not passed the requested floor) and has capacity (Step S3*c*), as illustrated in FIG. 9. A cab has capacity if it has available space to pick up one or more additional passengers.

The control system may restrict the number of people in a cab or limit the weight capacity. For example, the control system may limit the weight capacity for a cab to 400 pounds. A cab may contain a weight sensor or other means to determine its capacity. If a cab is at or over its weight limit, it does not have capacity. As such, if all the cab operating to service a designated region in the hoistway is at or over its capacity, the hoistway does not have capacity.

When the control system determines that a hoistway is operating in the same direction and has a cab approaching the floor with capacity, it identifies and selects this hoistway as the optimal hoistway (Step S4), as illustrated in FIG. 9. The request is then delegated to the optimal hoistway (Step S4*a*).

If more than one hoistway is found, the hoistway with the lowest load is identified as the optimal hoistway (Step S4) and the request is delegated to that hoistway (Step S4*a*). This load-balances traffic evenly across hoistways and increases the efficiency of the control system in servicing passenger requests.

If an optimal hoistway is not identified, the control system checks for an idle cab within the region. The request is then delegated to the idle cab. If no idle cabs are found within the region, the control system logs the request, waits for a cab within the region to switch operational directions and attempts to delegate the request again.

Figure 10:
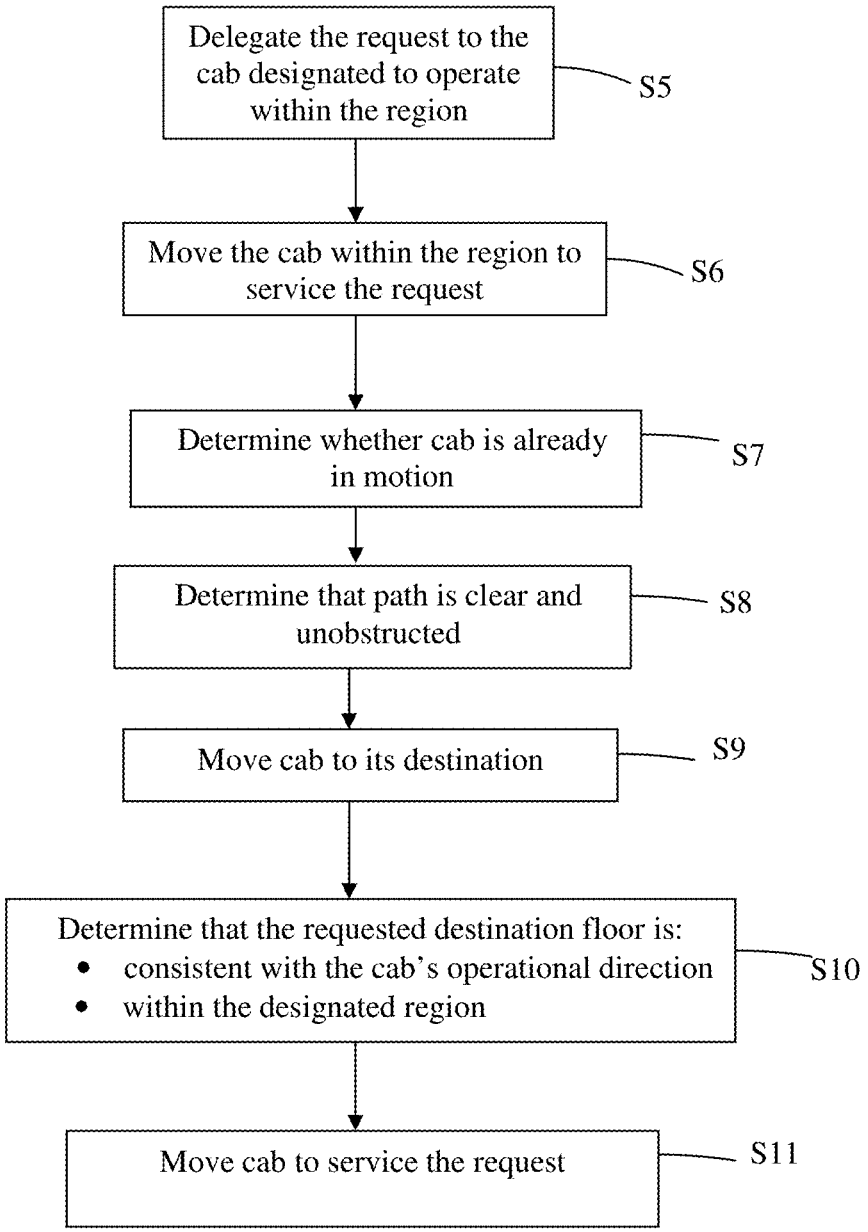
FIG. 10 is a flowchart illustrating an operation of delegating the request to a cab in the multi-cab elevator control method, according to an embodiment of the present invention.

When the optimal hoistway is identified (Step S4), the control system delegates the request to the cab operating within the floor range of the optimal hoistway (Step S5), as illustrated in FIG. 10.

As shown in FIG. 10, after a request is delegated to a cab, the cab is moved to service the request (Step S6). The control system may determine whether the cab is already in motion (Step S7), and checks to ensure the path is clear and unobstructed (Step S8). If the path is unobstructed, the cab continues to move to its destination to service the request (Step S9). If the path is obstructed, the cab stops and alerts the control system. When the cab is stopped at its destination floor, the doors will open or close as needed to allow passengers to board or disembark.

In an embodiment of the invention, when a passenger boards the cab and makes a request for a destination floor after boarding, the control system determines that the destination floor is consistent with the cab's operational direction and is a floor within its designated region (Step S10). In one embodiment, the button panel within the cab displays only active or available floors, the floors it is enabled to service.

After the control system determines that the destination floor is consistent with the operational direction of the cab and is a floor within the cab's designated region, the control system moves the cab (Step S11) to service the requested destination floor, or the next destination on its service list, as illustrated in FIG. 10.

In an embodiment of the invention, the control system organizes and maintains a service list for each cab. The service list contains the requests that are delegated to each cab and each cab is moved to service the requests on its corresponding service list.

Figure 11A:
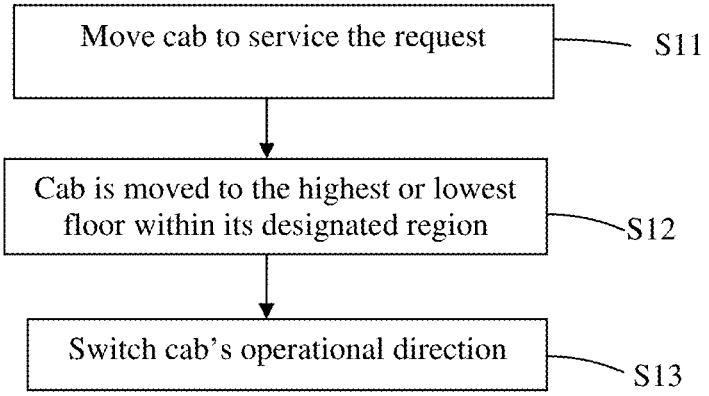
FIG. 11A is a flowchart illustrating a movement operation of private elevator control method, according to an embodiment of the present invention.

As illustrated in FIG. 11A, when the cab reaches the highest or lowest floor within its designated region (Step S12) and all passengers have disembarked, the control system switches the cab's operational direction to operate in the opposite direction (Step S13). For example, if a cab moving upwards reached the highest floor within its designated region, the control system may switch the operational direction of the cab to operate in the downward direction.

Figure 11B:
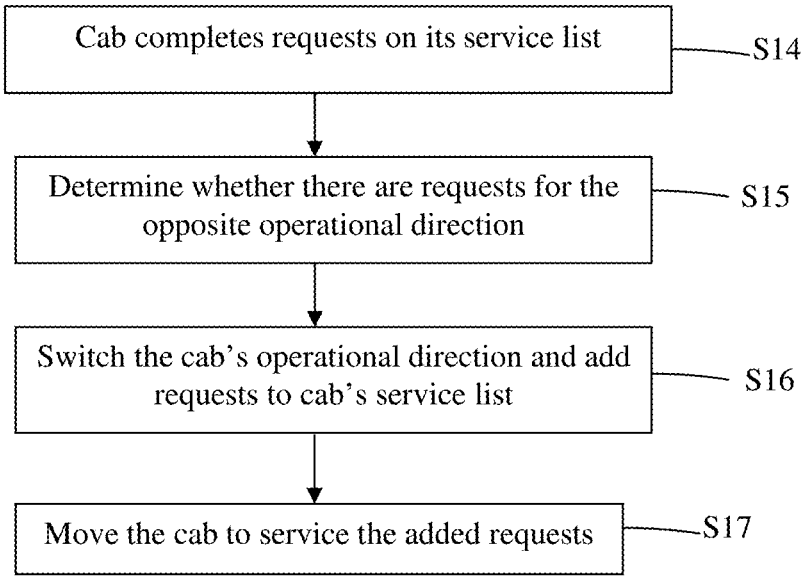
FIG. 11B is a flowchart illustrating a movement operation of private control method, according to an embodiment of the present invention.

In an alternative embodiment, as illustrated in FIG. 11B, if a cab completes servicing the requests in its service list going in its current operational direction (Step S14), the control system determines whether there are requests in the opposite direction (Step S15). If there are requests that require the cab to operate in the opposition direction, the control system will switch the cab's operational direction and add those requests to its service list (Step S16).

The control system will then move the cab to service the requests added (Step S17).

In another embodiment, if there are no requests in the opposite direction, the control system sets the cab to an idle status and waits for new requests. An idle cab may be activated to operate in either the upward or downward direction.

Fourth Embodiment

In a fourth embodiment of the current invention, building many contain one or more hoistways and each hoistway may be comprised of 1 or more floor ranges or hoistway ranges. Each floor range or hoistway range may contain and/or operate one or more cabs. The ranges may have a global direction in which groups of cabs move. Cabs operate within their designated floor range. The hoistways may have none or, one or more docking floors (attic & basement). The number of docking floors may differ at the base and/or top of a hoistway. Cabs may reach all the floors within their floor range provided the bottommost and topmost floors have adequate docking floors for multi-cab ranges. The cabs in the hoistway range can reach all the floors.

Within each hoistway, cabs may dock in the attic or basement reserve (docking) floors, if such floors are available. In one embodiment, there is one hoistway range and there are enough docking floors to allow all cabs within that hoistway range to access all the floors within that range.

In this embodiment, in an overloaded hoistway the number of cabs may exceed the number of docking spaces. In order to maximize a cab's operational range, cabs may temporarily travel outside of their floor range to clear a path for a companion cab. When this happens, a floor in a neighboring floor range is reserved for the cab to temporarily move into.

In an embodiment of the invention, at start-up, the control system is activated. The elevator system is comprised of one building (elevator control system), one or more hoistways (elevator shafts) within the building, one or more floor ranges within each hoistway, and one or more cabs (elevators) within each hoistway range. Each building contains one or more floors and passengers make elevator requests. Within hoistways, cabs may be either docked (in the attic or basement reserve slots) or in other configurations. Depending on where the cabs are docked, each hoistway range is set to operate in a direction, up or down. Depending on this direction, it may respond to up or down requests, but not both.

For instance, a hoistway range with cabs in the attic spaces will respond to downward requests. In order to respond to upward requests, it must move and dock all of its active cabs into the basement spaces and switch direction. After activation and cab arrangement, the system waits for requests. Normal operation: System waits for requests.

A passenger makes a request when the passenger walks up to the elevators on an active floor and pushes the call button. This creates a request for the floor and the direction of travel (up/down). Now the system will process the request by delegating it to the hoistway range and cab that are best suited to serve it.

The control system first delegates the request. In this embodiment, all the hoistways for this control system are centralized in one area, so the system can choose which would be the best hoistway to respond. In this embodiment, passengers board cabs that can serve their desired destination.

The control system then finds the best hoistway range to serve this request. It goes through a set of criteria to narrow the search for the best hoistway range. It checks the floor of the request and pulls the registered hoistway range on that floor. These are the ranges that can respond to this request. If a hoistway range already contains the request (a cab is already slated to visit that floor, traveling in the requested direction) then let that hoistway range process the previous request and this one together, without any further action. The control system can then return to a waiting state.

If a hoistway range that can reach the destination floor is found (assuming destination is already known), then system checks for the hoistway range operating in the same direction as the request. The system also checks for the hoistway range with capacity (available cabs with space). The system also checks for those cabs that have not passed this floor, are within stopping distance, and have this floor within their maximum and minimum range.

The system also checks for the hoistway range with the lowest load from all others (this load-balances traffic across hoistways evenly).

If the system determines that an optimal hoistway range to serve this request is found, it proceeds to find the best cab. If not, it checks to see if there are idle hoistway ranges (which do not have cabs in motion already). If so, the system gives the request to the first idle hoistway range and dispatches it to that range. If not, it may mean all active hoistway ranges are moving in a different direction already. The system then waits for a hoistway range to switch direction, and then tries to delegate this request again.

The system then determines the best cab. If a cab already contains this stop, the system automatically delegates the request to it. The system selects the closest cab within a safe stopping distance to this floor with capacity. This ensures this floor is within the cab's maximum and minimum range. The request is then delegated to that cab.

The system then moves cabs. For each hoistway range, the system performs the below described steps.

If a cab is waiting to change direction (all cabs are docked), the system checks if this hoistway range can switch operational directions. Continue waiting if there are already an optimal number of parallel hoistway ranges traveling in the new direction. Parallel hoistway ranges serve the same floors. (The optimal number of parallel hoistway ranges is half or more of all active hoistway ranges, by default.)

Waiting hoistway ranges are released by parallel hoistway ranges switching direction in the opposite direction or after a set time period has elapsed, to ensure they are not waiting a very long time. However, this prevents hoistway ranges from syncing their operational direction. If less than half of active parallel hoistway ranges are traveling in this new direction, the system proceeds with the direction switch.

The system switches direction by releasing any other waiting parallel hoistway ranges (in the opposite direction). The system gets the current active requests from the building, in this direction and splits them among the cabs. This is a divide-and-conquer strategy. In one embodiment, splits are even among the cabs, with the head cabs getting any remainder of requests. This allows the tail cabs to pick-up more subsequent requests while operating in this direction. The system also ensures that delegated floor stops are not outside the floor ranges of the cabs.

If not waiting, the system moves the cabs. The system may perform the following steps for each cab.

If the cab is already in motion, the system checks to ensure the path ahead is clear (and not obstructed by another cab). If the path is clear, continue moving cab to its destination. If path is blocked by another cab, the system requests for the blocking cab to move forward, one floor past the moving cab's destination. If the cab is stopped, open/close doors as needed. Allow passengers to board/disembark cab. Receive floor request from passengers who board, ensuring they do not conflict with the operational direction of movement. Ensure the request is within the cab's maximum and minimum floor range.

If cab is filled to capacity and more requests are active on the floor, the system dispatches the tailing cab within the same hoistway range to serve this floor by sending it this floor request. If the attic or basement cabs dock in the attic or basement spaces and the other cabs are idle, request direction switch. Wait for switch if an optimal number of hoistways are traveling in the new direction. Otherwise, proceed with switch. (See steps in prior section for details.)

If all cabs have been moved and have completed movement but they are not docked, set a docking stop to dock all the cabs in the attic/basement at their respective maximum and minimum floors. This ensures the hoistway is prepared for the next wave of passengers.

When switching direction, hoistway ranges may take cabs offline if the passenger load falls far below the current capacity. These cabs would remain in their docking areas. If there are no docking areas, these cabs may not be taken offline. When switching direction, if there are cabs offline, they may be brought online if the passenger load is exceeding current capacity (if a cab fills up).

If all cabs are docked and the direction is switched, wait for new requests and set status to idle.

Floor Reservations: In an overloaded hoistway range, if a cab destination request requires its companion cab to move out of the way, a reservation request is made to the neighboring hoistway range. This request may be denied, in which case, this cab would wait or simply not serve this request. However, if a request is accepted, the required floor(s) would be reserved in the neighboring range, allowing a companion cab to move out of the way temporarily. While this cab is in a neighboring range, its doors remain closed. This behavior uses an active passenger floor as a temporary docking space.

In an embodiment of the invention, the control system utilizes a method of dynamic cab allocation to take cabs offline during low-traffic periods. The system may also put cabs back online during high-traffic periods.

Figure 13:
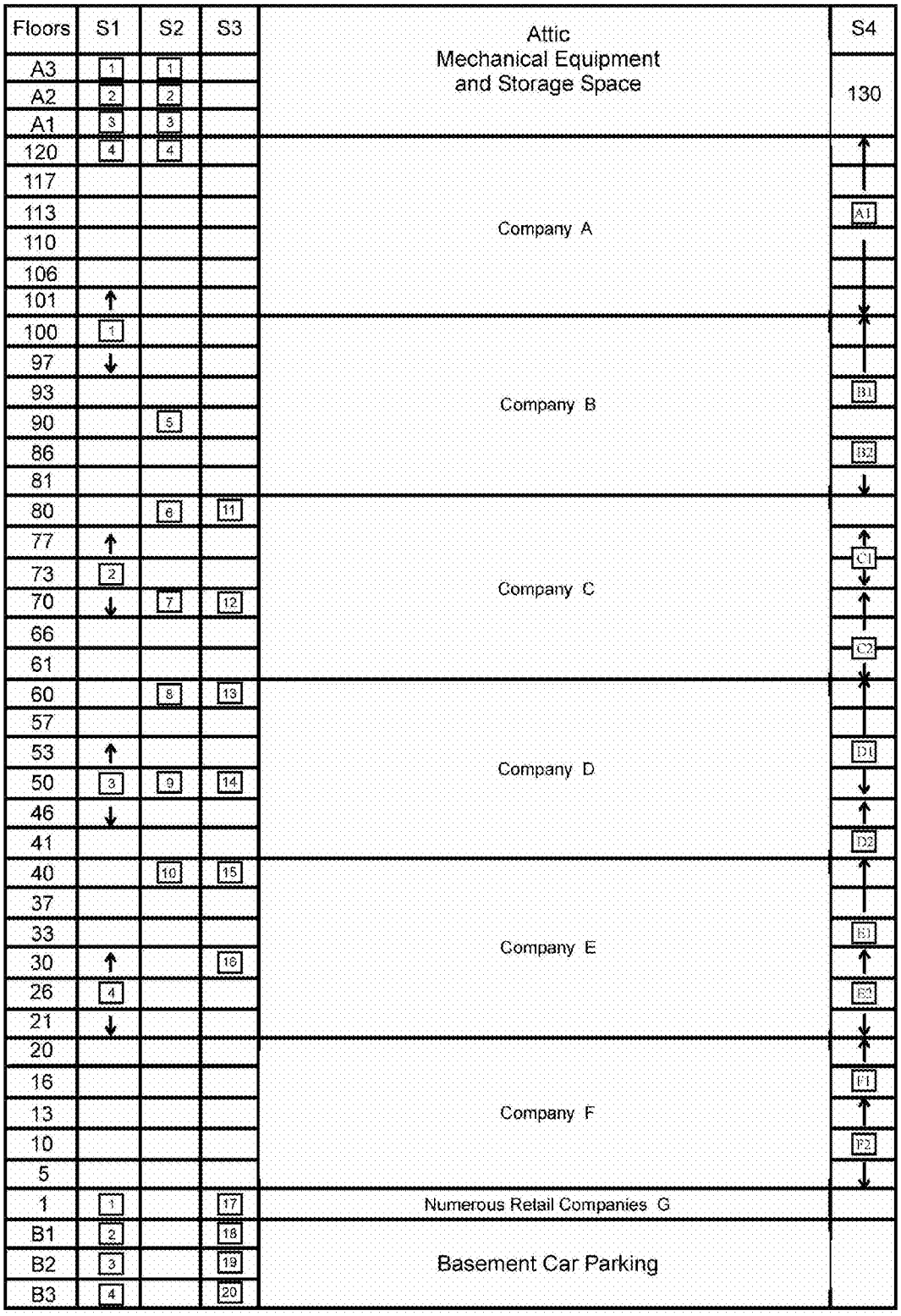
FIG. 13 is an illustration of the side view of a one hundred twenty story building which contains a plurality of elevator cabs, each moving independently in different vertical sections of four different hoistways, according to one embodiment of the present invention.

FIG. 13 is an illustration of a 120-floor office building which contains four different hoistways, each containing a plurality of elevator cabs, and each cab moves independently of the others in different vertical sections of the same hoistway, according to one embodiment of the present invention. In an embodiment, the 120-floor office building is occupied by six large companies (Company A, B, C, D, E and F), and each company occupies about 20 vertically adjoining floors. In this building, there are four different elevator shafts (S1, S2, S3, S4) that service various floors. FIG. 13 shows how multiple elevator cabs in each shaft move up and down over different periods of time, according to one embodiment.

In an embodiment of Shaft S1, there are four elevator cabs (1, 2, 3, 4) which access all floors in the building, including all three attic (equipment & storage) floors and all three basement (parking) floors. FIG. 13 shows all four elevator cabs (1, 2, 3, 4) docked in the lowest four floors and waiting to ascend; all four elevator cabs (1, 2, 3, 4) docked in the highest four floors and waiting to descend; all four elevator cabs (1, 2, 3, 4) moving independently of each other and going up or down between the other floors in the building. (see FIG. 12 for more details) All of these cabs (1, 2, 3, 4) moving in either direction (up or down) always stop at floor 1 (the street floor) to allow passengers to enter or exit.

In an embodiment of Shaft S2, there are ten elevator cabs (numbered 1 through 10) that move independently of each other through vertical sections of Shaft S2. Each of these cabs are only permitted by the central elevator computer control system to access about 70% of the floors in each direction of Shaft S2. As illustrated in FIG. 13 cabs 1, 2, 3, 4 have moved upward from lower floors of the building toward the top of the building and such four cabs (1, 2, 3, 4) are docked in the four topmost floors of the building (floors A3, A2, A1 and 120), awaiting their next downward journey. Cabs 5, 6, 7, 8, 9, and 10 respectively end their upward journeys at floors 90, 80, 70, 60, 50, 40. Passengers in any of the latter six cabs who wish to continue their upward journey to a higher floor are advised by the building's elevator computer control system to exit their cabs at such floors and to take a specified cab in Shaft S1 or Shaft S3 to continue their journey to their higher desired destination floor.

At this juncture all cabs (1 through 10) in Shaft S2 prepare for and begin their descent down Shaft 2 toward the designated floors where they must stop. Cabs 7, 8, 9, 10 proceed to service floors toward the bottommost four floors (B3, B2, B1, and 1) where they will be docked awaiting their next upward journey. Cabs 1, 2, 3, 4, 5, 6 move downward servicing floors and respectively end their downward journey at floors 80, 70, 60, 50, 40, and 30 (as is illustrated by the ten cabs shown in Shaft S3). Passengers in any of the latter six cabs who wish to continue their downward journey to floors 1, B1, B2 or B3 or other lower floors are advised by the building's elevator computer control system to exit their cabs at such floors and to take a specified cab in Shaft S1 or Shaft S3 to continue their journey to their lower desired destination floor. At this point the above process begins to repeat itself in Shaft S2.

Meanwhile, in another embodiment, there are also ten elevator cabs (numbered 11 through 20) in Shaft S3 that move independently of each other through vertical sections of Shaft S3. In an embodiment, each of these cabs can also only access about 70% of the floors in the building in each direction of Shaft S3. As illustrated in FIG. 13, cabs 17, 18, 19, 20 have moved downward to the bottom of the building and are docked in the four bottommost floors (1, B1, B2 and B3), awaiting their next upward journey. Cabs 11, 12, 13, 14, 15 and 16 respectively end their downward journey at floors 80, 70, 60, 50, 40, 30. Passengers in any of the latter six cabs who wish to continue their downward journey to a lower floor are advised by the building's central elevator computer control system to exit their cabs at such floors and take a specified cab in Shaft S1 or Shaft S2 to continue their journey to their lower desired destination floor. At this juncture all cabs in Shaft S3 begin their assent up Shaft S3 to the designated floors where they must stop (as illustrated in Shaft S2), and the above process begins to repeat itself in Shaft S3. The cabs in Shaft 2 and Shaft 3 operate in conjunction with each other to service as many floors and passengers as possible in the shortest possible time periods.

Because these embodiments are so efficient and contain so many elevator cabs, only two elevator shafts may be sufficient to service the entire 120 floors. Likewise, two elevator shafts which each contain twenty elevator cabs and operate in similar fashion to S2 and S3, may be sufficient to service a building with over two hundred floors.

In a 160-floor building, the owner might want 15 or more elevator cabs to operate at the same time in the same elevator shaft. Moreover, in a 200-floor building, the building owner might even want 20 cabs to operate at the same time in an elevator shaft.

Because up to twenty elevator cabs can operate independently in the same elevator shaft, only two elevator shafts may be necessary in order to service any tall building, no matter how many floors there are in the building being serviced. For example, even a two hundred floor building can be adequately serviced by forty elevator cabs operating in only two hoistways located in such building. Thus, this sharing of hoistways by multiple elevator cabs can result in a great saving of cost, materials and building space, and a great increase in cab passenger capacity in any given elevator shaft.

Shaft S4 is an illustration of a hoistway which is dedicated to private elevators for each of the six companies (Company A through Company F) which leases or owns about twenty adjoining floors in the 120-floor building. In an embodiment, each company may choose to have one or two private elevator cabs operate in its private section of the hoistway S4. If company A chooses to have just one private elevator cab that will service all twenty of its private floors (floor 101 to floor 120), then there will be no problems for such cab (shown as A1 in Shaft 4) to access all of A company's floors between floor 101 and floor 120. Nor will there be any possibility of elevator cab collisions in the Company A's private section of Shaft S4. Nor will any storage slots be necessary for just one elevator cab. However, the wait time for just one private elevator cab, and the limited number of passengers that can be serviced by just one cab, may become problems.

In an alternate embodiment, if another Company C chooses to have two private elevators operate in its private section of Shaft S4 that will service all twenty of its adjoining private floors (floor 61 to floor 80), then certain problems must be considered and solved. In an embodiment, if company C always operates its two elevators within its private section of Shaft S4 and in the same direction, and does not require that both elevator cabs can access all of its adjoining floors in each direction, then the building's central elevator computer control system can handle these simple requirements without any cab collisions or storage slots.

But if company C requires that both cabs must access all of its floors in each direction then something creative must be done. In an embodiment, the building owner may require that the cab slot at each end of a private elevator shaft section be shared by the cabs of each neighboring company. The building's central elevator computer control system may then be programmed so that only one neighboring cab (i.e. cab B2 shown on FIG. 13) can enter the shareable slot (i.e. at floor 80 or floor 81) at the same time, and that the other neighboring cab (i.e. cab C1 shown on FIG. 13) must delay its entry into either of those shareable slots until the shareable slot is empty again.

In an alternate embodiment, the building owner could require that during business hours all private elevators in the building must continuously move in the same direction (i.e. up or down) at all times so that the shareable neighboring slot in the direction of such motion will always be available for entry. Then during non-business hours the building owner could require that only one elevator can be operated in any direction in Shaft 4, or that the nearby stairs may be infrequently required for passengers to access a certain adjacent floor. It should be realized that there are also other possible solutions for these problems.

If there were up to twenty companies in the 120-floor building described in FIG. 13 (instead of six) that desired to have a private elevator operate between their adjoining floors on the same hoistway, this desire could also be accommodated by the elevator system.

With regard to any of the above described private elevator scenarios, if a company wishes to expand into vacant adjoining floors, the elevator control system can instantly accommodate these wishes by a simple computer program change, and without any costly or time consuming physical changes to the private elevator cabs or any private elevator shaft. The same is true if any company wishes to sell or surrender any adjoining floors to a neighboring company. Thus it has been demonstrated that the embodiments of present invention and its control method have great efficiencies and flexibilities. When the occupants of any of the above describes private elevator floors wish to travel to the floors of another company in the building (e.g. the street level on floor 1, or any of the attic [storage] or basement [parking] floors), they must use the elevator cabs in Shaft S1 or Shaft S2 or Shaft S3 that are available for the general public.

Figure 14:
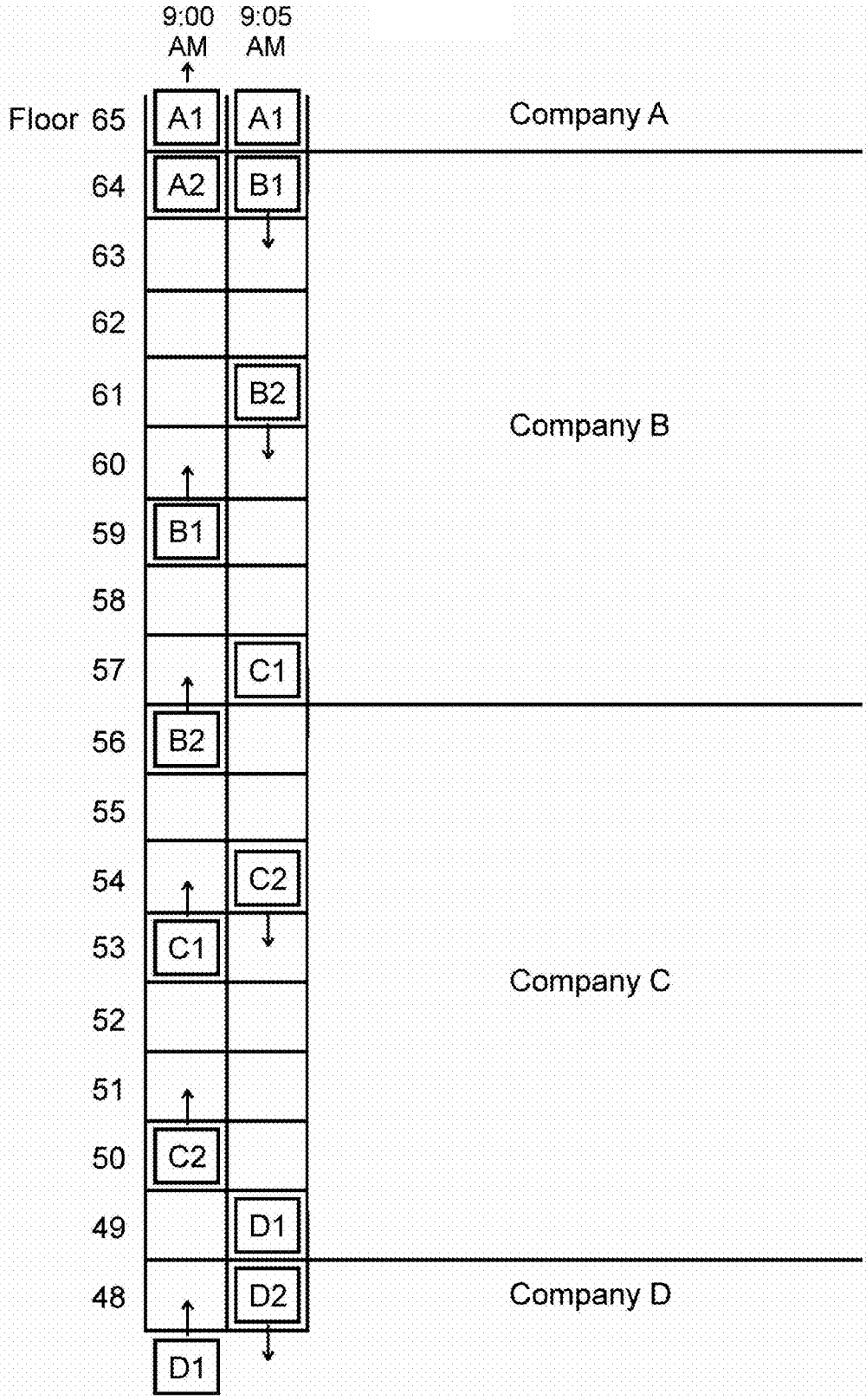
FIG. 14 is an illustration of two different private sections of the same hoistway where elevator slots may be shared by two different neighboring private elevator cabs over a period of time, according to one embodiment of the present invention.

FIG. 14 is an illustration of two different private sections in the same hoistway where elevator slots may be shared by two different neighboring elevator cabs at two different times, according to one embodiment of the present invention. As shown in FIG. 14, four companies (A, B, C, D) occupy premises with adjoining floors in a tall building. In one embodiment, Company A and Company B share private elevator slots on floors 64 and 65; Company B and Company C share private elevator slots on floors 56 and 57; Company C and Company D share private elevator slots on floors 48 and 49.

As shown on FIG. 14, at 9:00 AM, private elevator cab A2 has already unloaded its Company A passengers on floor 65 and is now stored in Company B's shareable slot on floor 64. Private cab A1 is loading Company A employees on floor 65 and is preparing to ascend to upper destinations on Company A's adjoining floors. Private cab B1 has already unloaded and loaded its Company B passengers on floor 57 and is now ascending to service Company B floors 60 through 64. Cab B2 is stored in Company C's shareable slot on floor 56 and is beginning to move up to slot 57 to load Company B passengers destined for higher Company B adjoining floors. Private cab C1 is ascending to service Company C floors 54 through 56, and then it will be stored in Company B's shareable slot on floor 57 after cab B2 moves up to slot 58. Private cab C2 has already picked up Company C passengers on floor 49 and is ascending to service other Company C floors. Private cab D1 is just entering the shareable slot on floor 48 to unload Company D passengers and will then dock in Company C's shareable slot on floor 49 that cab C2 has just vacated.

As shown on FIG. 14, at 9:05 A.M. private elevator cab D2 has just picked up Company D passengers on floor 4 48 and is descending through company D's private section of the hoistway to service lower Company D adjoining floors. Private cab D1 is docked in Company C's shareable slot on floor 49, and is preparing to follow cab D1 down through Company D's floors. Private cab C2 has already serviced Company C's floors 56 through 54 and is preparing to service Company C floors 53 through 50, and also floor 49 after cab D1 has exited that shareable slot. Private cab C1 is docked in Company B's shareable slot on floor 57 and is preparing to follow cab C2 down through Company C's adjoining floors. Private cab B2 has already serviced Company B's upper floors and is descending through Company B's private section of the hoistway to service Company B's lower floors until it docks in Company C's shareable slot on floor 56 after cab C1 has moved down to floor 55. Private cab B1 has already vacated shareable slot 65, has picked up Company B passengers on floor 64 and is now descending to service lower Company B floors. Cab A1 has just unloaded Company A passengers on floor 65 and will dock in Company B's sharable slot on floor 64 after cab B1 has exited that slot. The motions of all of the above cabs are controlled by the building's central elevator control system in conjunction with electronic and optical sensors located on such cabs and within the private elevator hoistway S4, in one embodiment.

In another embodiment, the elevator system with more than one hoistway may have one hoistway enabled to service regions and the remaining hoistways enabled to service all floors. Alternatively, more than one hoistway is enabled to service regions and these hoistways can be enabled service all floors of the building.

In another embodiment, the control method responds dynamically to enable a hoistway servicing all floors to switch to servicing regions. In this embodiment the control method determines passenger needs from the requests and enables a hoistway to service regions to allow express service and dynamically switches back to servicing all floors when the need to express passengers to specific floors is fulfilled.

Turning to FIGS. 15A through 15F, the above-discussed reservation system made among ranges within a single hoistway as operated by the control system is further illustrated, according to embodiments of the present invention. This reservation system is used when a private hoistway is overloaded with more than one cab per range. Such overloading necessitates sharing adjoining floors between ranges to give cabs access to all the floors in their range (without using docking spots). Reservations are made when a particular cab's next destination is blocked by a cab within its own range, when that cab has reached its maximum normal range. The range needs to essentially borrow a floor from its neighbor, so the range sends a request for reservation. If the floor requested is clear, i.e. no active requests are on it and no active cabs are on it, then the reservation is accepted and the floor is reserved. If any idle cabs are on the floor, the idle cabs are moved out of the way. Reservations are made on a first-come first-serve basis, such that if the hoistway accepting the reservation needs to make a reservation of its own, it must wait for the floors to clear.

Figure 15A:
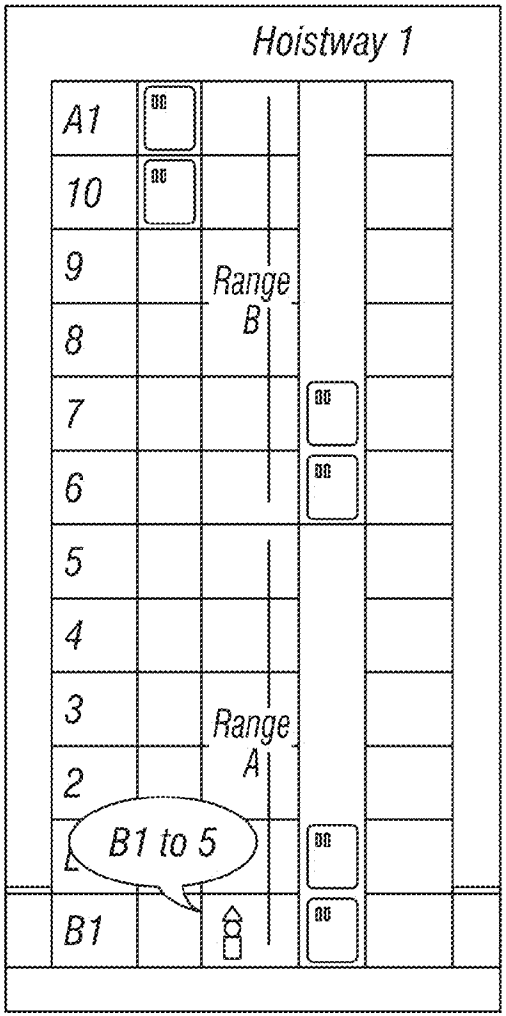
FIGS. 15A through 15F illustrate the reservation system made among ranges within a single hoistway as operated by the control system, according to embodiments of the present invention.
Figure 15B:
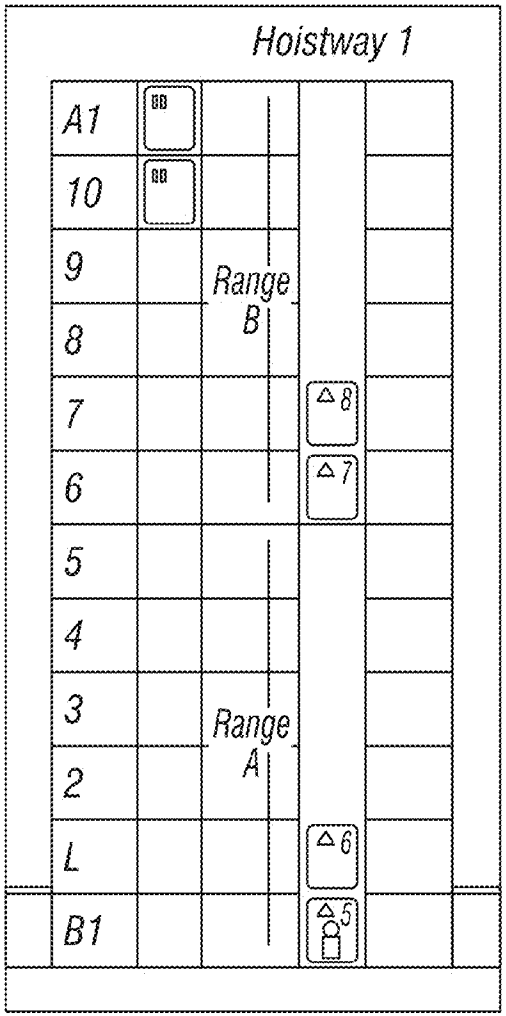
Figure 15C:
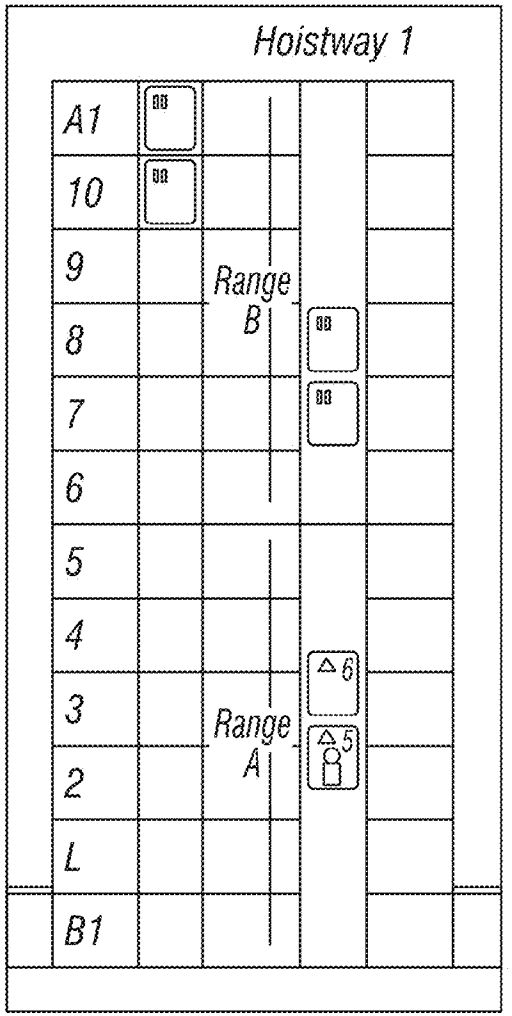
Figure 15D:
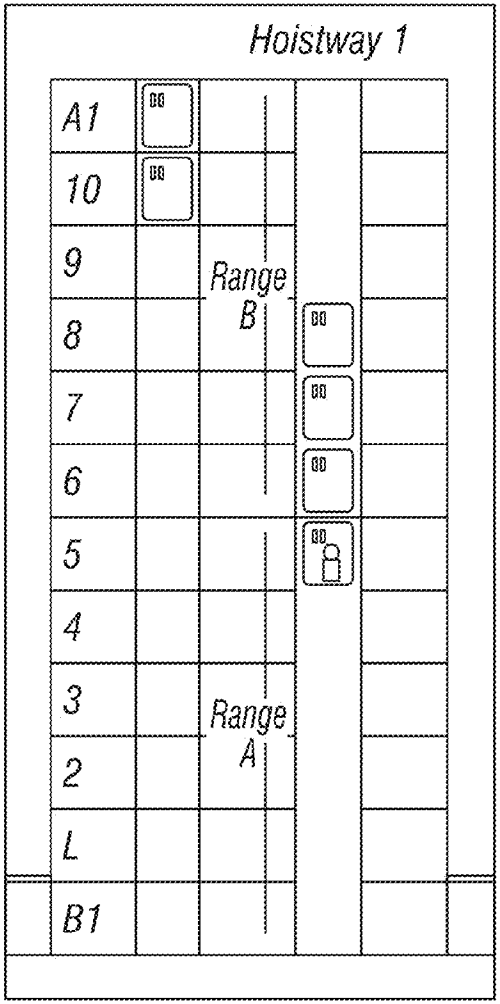
Figure 15E:
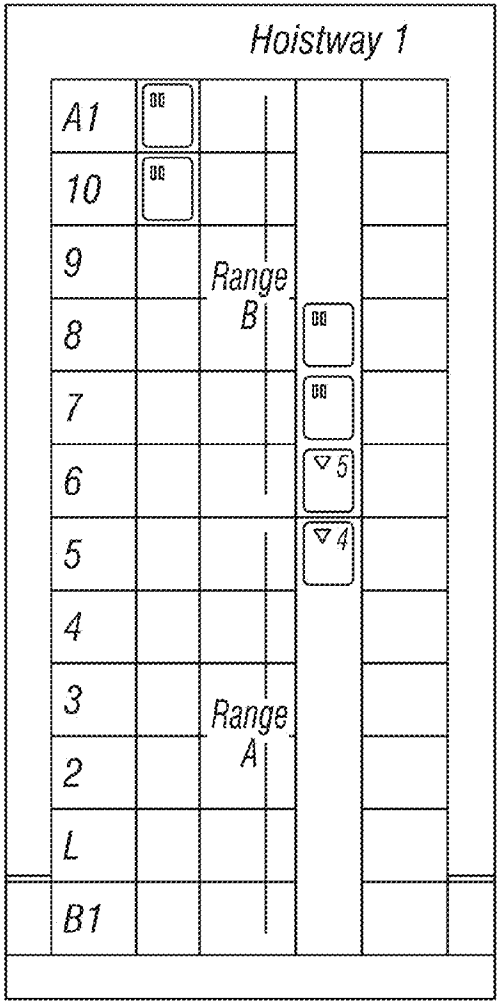
Figure 15F:
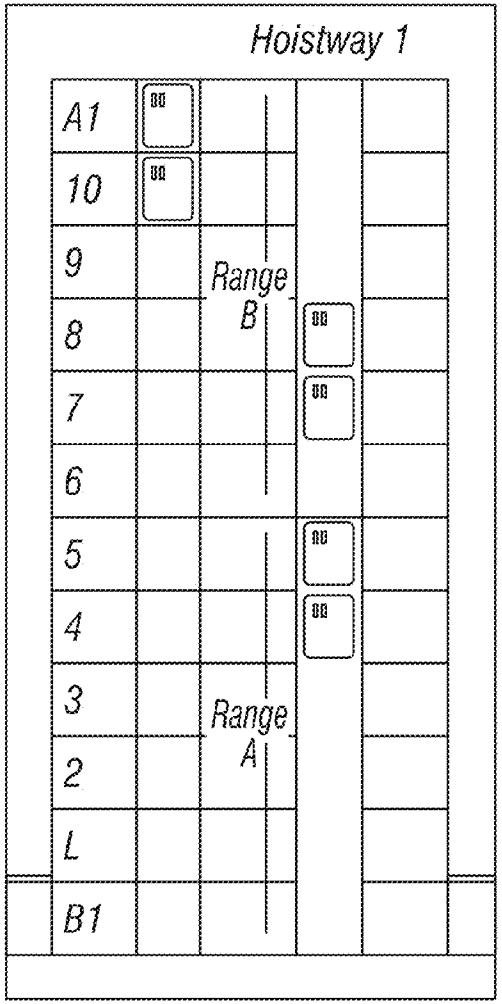

As particularly illustrated in FIG. 15A, there is an example of a single hoistway (Hoistway 1) comprising two ranges, where each range contains two cabs. Range A is from floor B1 through floor 5. Range B is from floor 6 through floor A1. As shown, a passenger wants to travel from floor B1 to floor 5 and puts in a request. In FIG. 15B, the passenger boards the bottom-most cab. Range A makes a reservation request for Floor 6, where its top cab must go temporarily so its bottom cab can reach Floor 5. Range B accepts. In FIG. 15C, range B's cabs move out of the way for Range A's cabs, which are now en route. As shown in FIG. 15D, range A's cabs arrive. The passenger disembarks on Floor 5. In FIG. 15E, range A's cabs immediately move out of the neighboring range, as shown by the descending cabs. The ranges reset. As shown in FIG. 15F, the reservation is cancelled, i.e. in an end state; Range B can now access Floor 6 once more.

Figure 16:
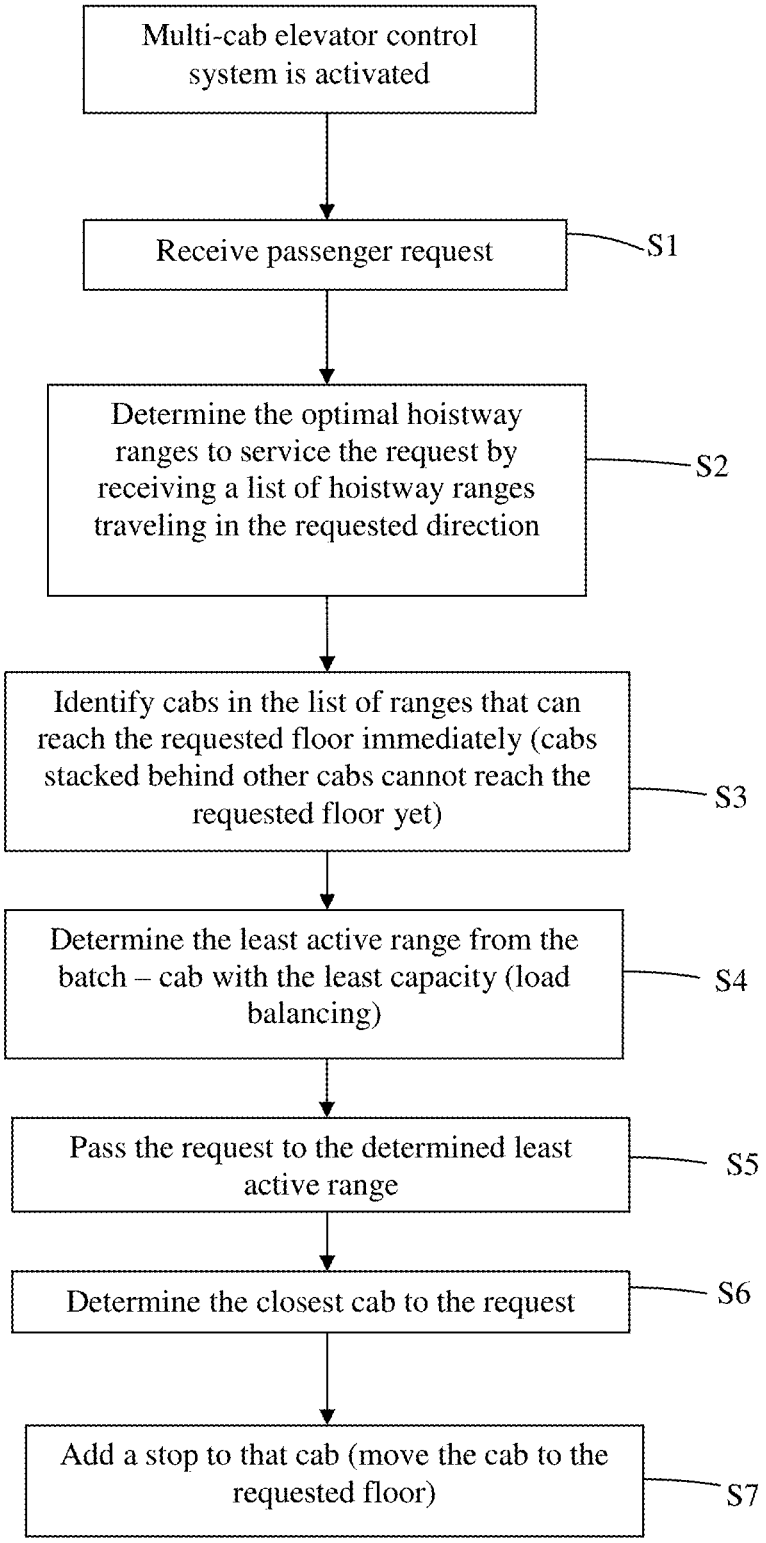
FIG. 16 is a flowchart illustrating a movement operation of the elevator control method using delegation by optimal hoistway range, according to an embodiment of the present invention.

The method according to the reservation system as illustrated in FIG. 16, essentially comprises the steps of the control system receiving a new request (step S1); receiving a list of hoistway ranges traveling in that requested direction (step S2); receiving cabs that can reach that floor immediately (cabs stacked behind other cabs cannot reach that floor yet) (step S3); determining a least active range from the batch (load balancing) (step S4); passing the request to that range (step S5) (i.e. the passenger request is delegated to the range's controller); determining the closest cab to that request (step S6) and adding a stop to it (step S7).

Accordingly, with the reservation procedure, cabs may reserve temporary docking spaces within neighboring hoistway ranges within a multi-cab private range system. This allows a cab to temporarily enter a neighboring hoistway range to move out of the way for a companion cab, in order for that companion cab to access the topmost or lowermost floors in their shared range. Each cab has a maximum and minimum operational range. This can be defined as a high floor and a low floor within which it operates. This range may be exceeded in special circumstances, such as to give neighboring cabs access to more floors, but must be authorized by the hoistway, to ensure no collisions or deadlocks occur.

Such a system and control method allows for greater flexibility and increased efficiencies in private range configurations. A building may comprise one or more hoistways, each with one or more hoistway ranges for cabs to operate within; and each hoistway range may accommodate one or more cabs. The building may include one or more docking floors to improve performance of the system. Each of the one or more cabs operates within the same direction when within a hoistway range, thereby cab direction is range dependent. Cabs have the capability of reaching all floors within their range, provided the bottom most and topmost floors have adequate docking floors for multi-cab ranges.

Figure 17:
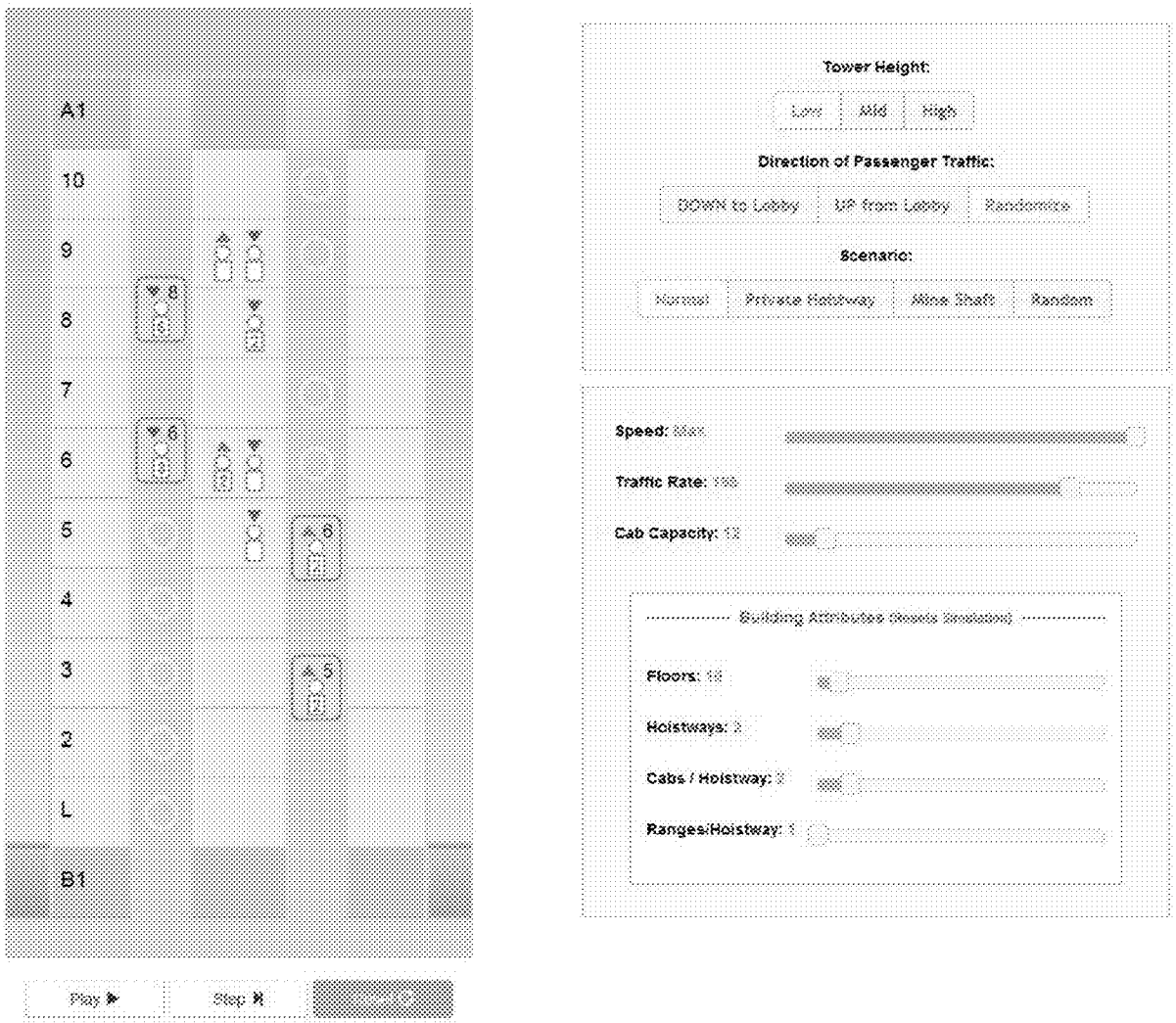
FIG. 17 illustrates a screenshot of the control system simulator user interface according to an embodiment of the present invention.

As illustrated in FIG. 17, there is an example screenshot of the control system simulator user interface according to an embodiment of the present invention. The simulator provides a visual understanding of the control of the multi-cab system based on user entered parameters. Upon entry of the parameters, the simulator plays out the sequence of cab movement which may be paused and continued, or viewed by steps. The sequence may be reset for adjustment of parameters. User adjusted parameters may include the structure height, i.e. number of floors including number of attic and basement levels (low, mid, high); direction of passenger traffic (down to lobby, up from lobby, random); scenario (normal, private hoistway, mine shaft, random). The simulator allows adjustments to the speeds displayed, traffic rate and cab capacity by adjusting the corresponding bars. Importantly, the building attributes are adjustable to simulate a number of variations by adjusting the number of floors, the number of hoistways in the shaft, the number of cabs within a single hoistway, and the number of ranges within a single hoistway.

The example of FIG. 17 illustrates a simulation of ten floors with two hoistways, each hoistway having two cabs and running with a single hoistway range. The simulator could run with higher parameters on all levels, for example with a 110 floor structure, 10 hoistways, 10 cabs per hoistway and 10 ranges per hoistway. The control method and system of the present invention may perform, and be configured to perform such functions as demonstrated by the simulator.

In alternate embodiments, a passenger request can be made using a 10-keypad to enter the passenger's destination floor prior to boarding the cab. For example, a passenger may make a request for an elevator cab by punching in his/her desired destination floor at the building lobby. The keypad may be located outside the hoistway shaft, and communicates a request to the control system with information regarding the requested floor, the destination direction (upwards or downwards), and the destination floor. Other methods of requesting an elevator cab and communicating a passenger's desired destination floor may also be used.

In alternate embodiments, the control system and method enables a multi-cab elevator system to identify the optimal hoistway and best cab suited to horizontally transport a passenger from a point of origin to a destination. It is envisioned that the control method can be utilized to enable a multi-cab elevator system to transport passengers in any direction, including vertically, horizontally, or diagonally.

While particular embodiments and applications of the present invention have been illustrated and described herein, it is to be understood that the invention is not limited to the precise construction and components disclosed herein and that various modifications, changes, and variations may be made in the arrangement, operation, and details of the methods and apparatuses of the present invention without departing from the spirit and scope of the invention as it is defined in the appended claims.

What is claimed is:

1. A method for controlling a multi-cab elevator system on a computer, the elevator system having one or more hoistways, each hoistway having a plurality of cabs, the computer comprising a processor, a memory operatively coupled to the processor, the memory storing code executed by the processor for implementing the method including:

receiving a request, said request including information regarding a requested floor and a required direction of movement;

determining and selecting an optimal hoistway among the one or more hoistways, wherein a hoistway that is already servicing a prior request to the requested floor, in the required direction of movement, is selected as the optimal hoistway;

for a hoistway that is not already servicing a prior request to the requested floor in the required direction of movement, the optimal hoistway is determined and selected from the one or more hoistways by utilizing information regarding whether the hoistway is traveling in the required direction of movement, has capacity and contains a cab that is traveling within a stopping distance to the requested floor;

determining and selecting a best cab among the plurality of cabs in the optimal hoistway, wherein a cab already servicing the requested floor is selected as the best cab;

for a cab that is not already servicing the requested floor, the best cab is determined and selected from the plurality of cabs utilizing information regarding whether the cab is within a safe stopping distance of the requested floor;

delegating the request to the best cab selected; and moving the best cab to service the request.

2. The method of claim 1, wherein determining whether a hoistway has capacity utilizes information regarding a number of requests the hoistway is currently servicing.

3. The method of claim 1, wherein determining and selecting the optimal hoistway includes determining and selecting the hoistway with the lowest load, if more than one hoistway is traveling in the required direction of movement, wherein the hoistway with the lowest load is the hoistway that is currently servicing the fewest number of requests.

4. The method of claim 1, further comprising:

moving the best cab into a docking slot, wherein the docking slot is a floor at a top of the optimal hoistway, and waiting to receive a next request.

5. The method of claim 1, further comprising:

moving the best cab to a docking slot, wherein the docking slot is a floor at a bottom of the optimal hoistway, and waiting to receive a next request.

6. The method of claim 1, where determining and selecting the best cab, for a cab that is not already servicing the requested floor, further comprises determining and selecting a cab with capacity.

7. The method of claim 1, wherein the method further comprises moving the best cab into a docketing slot and switching an operational direction of the optimal hoistway in preparation for servicing future requests.

8. The method of claim 7, further comprising switching the operational direction of the hoistway after a determination that the hoistway has been waiting a set period of time.

9. The method of claim 7, where switching the operational direction of the hoistway occurs after a determination that a different hoistway traveling in the opposite direction has docked and switched its operational direction.

10. The method of claim 7, where switching the operational direction of the hoistway occurs after a determination that an optimal number of hoistways is traveling in an opposite direction, wherein said optimal number of hoistways is at least half of the hoistways.

11. A method for controlling a multi-cab elevator system on a computer comprising a processor, a memory operatively coupled to the processor, the memory storing code executed by the processor for implementing the method including:

receiving a passenger request from a requesting floor to a destination floor, said request including information regarding a direction of travel in a structure with one or more hoistways, each hoistway comprising a plurality of hoistway ranges and a plurality of cabs, wherein each cab services requests on its corresponding service list;

determining an optimal hoistway amongst the one or more hoistways by determining an optimal hoistway range, wherein each hoistway range comprises a plurality of succeeding floors within the structure and is set to operate in an operational direction, and selecting the optimal hoistway range in response to a determination that a hoistway range is moving in the direction of travel of the request and has capacity;

determining a best cab amongst the cabs of the optimal hoistway range and selecting the best cab in response to a determination that the cab is within a stopping distance of the requesting floor and has capacity; and delegating the request to the best cab and adding the request to the service list of the best cab.

12. The method of claim 11, further comprising:

determining that a pathway of the best cab is unobstructed, and where another cab is blocking movement of the best cab, waiting for the pathway to become unobstructed; and moving the best cab in response to the request when the pathway of the best cab becomes unobstructed.

13. The method of claim 11, further comprising:

waiting for the optimal hoistway range to switch operational directions while the optimal hoistway range is in a waiting mode, and the cabs of the optimal hoistway range are idle and docked in at least one storage slot of the hoistway range, wherein said at least one storage slot is the top most or bottom most slot of the hoistway range.

14. The method of claim 11, further comprising:

determining that a pathway of the best cab is obstructed by an obstructing cab belonging to the optimal hoistway range that has reached a maximum floor in the optimal hoistway range;

sending a reservation request to reserve a next floor, after the maximum floor of the optimal hoistway range, in a neighboring hoistway range;

where the next floor is clear, moving the obstructing cab temporarily into the next floor; and moving the best cab when the pathway of the best cab becomes unobstructed.

15. The method of claim 11, further comprising:

determining that a pathway of the best cab is obstructed by an obstructing cab belonging to the optimal hoistway range that has reached a maximum floor in the optimal hoistway range;

sending a reservation request to reserve a next floor, after the maximum floor of the optimal hoistway range, in a neighboring hoistway range;

where the next floor is occupied by an idle cab of the neighboring hoistway range, then moving the idle cab to another floor of the neighboring hoistway range and then moving the obstructing cab temporarily into the next floor; and moving the best cab when the pathway of the best cab becomes unobstructed.

16. The method of claim 13, further comprising:

setting the operational direction of the optimal hoistway range to travel in an opposite operational direction from a previous operational direction of the optimal hoistway range, determining that the optimal hoistway range has been waiting for a set period of time, and moving the best cab to service the request.

17. The method of claim 13, further comprising:

setting the operational direction of the optimal hoistway range to travel in an opposite operational direction from a previous operational direction of the optimal hoistway range, in response to a determination that another hoistway range amongst the plurality of hoistway ranges has been set to operate in the previous operational direction, and moving the best cab to service the request.

18. The method of claim 13, further comprising:

receiving one or more other passenger requests for a same direction of travel in addition to the passenger request, delegating the one or more other passenger requests evenly to the service list of the best cab and the service list of each of the other cabs of the optimal hoistway range, and moving each cab to service the requests on its corresponding service lists.

19. The method of claim 11, further comprising:

moving the best cab to service the passenger request, waiting to receive a next passenger request, and in response to a communication regarding an obstructed pathway of another cab, moving the best cab to clear the obstructed pathway.

20. The method of claim 11, further comprising:

moving the best cab to service the passenger request, and in response to a communication regarding obstructing a pathway of a tailing cab, moving and docking the best cab into a storage slot of the hoistway range.

21. A control system for a multi-cab elevator system in a structure comprising a plurality of hoistways, each hoistway comprising a plurality of cabs, and at least one destination request device, the control system comprising:

a controller for servicing requests in the structure through the destination request device, the controller configured to:

receive a passenger request from a requesting floor to a destination floor, said passenger request including information regarding a direction of travel in the structure;

determine an optimal hoistway amongst the plurality of hoistways, wherein each hoistway is set to operate in an operational direction, and select the optimal hoistway in response to a determination that the hoistway is moving in the direction of travel of the passenger request and has capacity;

determine a best cab amongst the cabs of the optimal hoistway and select the best cab in response to a determination that the cab is within a stopping distance of the requesting floor and has capacity; and delegate the passenger request to the best cab and adding the passenger request to a service list of the best cab.

22. The control system according to claim 21, wherein each hoistway comprises a plurality of hoistway ranges and each hoistway range comprises a plurality of succeeding floors within the structure; wherein determining an optimal hoistway amongst the plurality of hoistways includes determining an optimal hoistway range; and wherein determining a best cab amongst the cabs of the optimal hoistway includes determining the best cab is amongst the cabs of the optimal hoistway range.

23. A computer program product stored on a non-transitory computer-readable storage medium having instructions recorded thereon, that when executed by one or more processors, cause the one or more processors to:

receive a passenger request from a requesting floor to a destination floor, said request including information regarding a direction of travel in a structure with one or more hoistways, each hoistway comprising a plurality of hoistway ranges and a plurality of cabs, wherein each cab services requests on its corresponding service list;

determine an optimal hoistway amongst the one or more hoistways by determining an optimal hoistway range, wherein each hoistway range comprises a plurality of succeeding floors within the structure and is set to operate in an operational direction, and select the optimal hoistway range in response to a determination that a hoistway range is moving in the direction of travel of the request and has capacity;

determine a best cab amongst the cabs of the optimal hoistway range and select the best cab in response to a determination that the cab is within a stopping distance of the requesting floor and has capacity; and delegate the request to the best cab and add the request to the service list of the best cab.

* * * * *